US005253599A

United States Patent [19]

Hashiride

[11] Patent Number: 5,253,599

[45] Date of Patent: Oct. 19, 1993

[54] EMBROIDERING SYSTEM AND CONTROL SYSTEM THEREFOR

[75] Inventor: Tadaaki Hashiride, Okazaki, Japan

[73] Assignee: Aisin Seiki Kabushiki Kaisha, Kariya, Japan

[21] Appl. No.: 947,574

[22] Filed: Sep. 21, 1992

[30] Foreign Application Priority Data

Sep. 20, 1991 [JP] Japan ..... 3-241669

[51] Int. Cl.[5] ..... D05B 21/00; D05B 25/00

[52] U.S. Cl. ..... 112/121.12; 112/103; 112/155; 112/445

[58] Field of Search ..... 112/121.12, 103, 445, 112/121.11, 155, 2; 364/470

[56] References Cited

U.S. PATENT DOCUMENTS

| | | | |
|---|---|---|---|
| 4,352,334 | 10/1982 | Childs et al. | 112/266.1 |
| 4,369,722 | 1/1983 | Nishida et al. | 112/103 |
| 4,413,574 | 11/1983 | Hirota et al. | 112/121.12 |
| 4,932,342 | 6/1990 | Hisatake et al. | 112/155 X |
| 4,936,232 | 6/1990 | Monma | 112/155 |

FOREIGN PATENT DOCUMENTS 123448 9/1981 Japan .

*Primary Examiner*—Peter Nerbun

*Attorney, Agent, or Firm*—Burns, Doane, Swecker & Mathis

[57] ABSTRACT

An embroidering system comprises plural embroidering machines, a display, an input, a register memory for storing plural embroidering patterns, image data and embroidering data which includes data for characters of several languages having different character symbols in the same phonetic sound, and a main control. When an operator selects a desired language, the main control reads the image data which corresponds to the selected language from the register memory. When an operator selects a key on the keyboard, the main control checks a phonetic sound of that key to determine whether such phonetic sound corresponds to more than one character. If there is more than one character, the main control reads image data corresponding to all of the characters which have the same phonetic sound and displays all of the image data. An operator selects a desired character from the displayed characters. Then the main control registers the desired character into a register memory, and sends embroidering data corresponding to the registered embroidering pattern to a memory of an embroidering machine. Thus an operator can select any language characters and register them as a new embroidering pattern.

8 Claims, 34 Drawing Sheets

FIG. 23

CHARACTER FILE

| | 0 | 1 | 2 | 3 | 4 | 5 | | | F |
|---|---|---|---|---|---|---|---|---|---|
| 2330 | 0 | 1 | 2 | 3 | 4 | 5 | | | |
| 2340 | | A | B | C | D | E | | | O |
| 2350 | P | Q | R | S | T | U | | | |
| 2360 | | a | b | | | | | | |

FIG. 24

NAME REGISTER

| ORDER | NM1 | NM2 | .... | LAST (NMm) |
|---|---|---|---|---|
| CHARACTER | A | I | .... | N |
| FILE NAME | F1 = 2341. 100 | F2 = 2349. 100 | .... | Fm = 234E. 100 |
| DATA | CH 1 | CH 2 | .... | CHm |

(a)

RELATIVE COORDINATES $S_n(X_n, y_n)$
$S_0(X_0, y_0) = (0, 0)$
$S_1(X_1, y_1) = (-5, -6)$
$\vdots$
$S_n(X_n, y_n) = (\Delta X, \Delta y)$ (b)

S : CENTER $S_{Rn}(X_n, y_n)$
$S_{R0}(X_0, y_0)$
$S_{R1}(X_1, y_1)$
$\vdots$
$S_{Rn}(X_n, y_n)$

| ORDER | | 1ST | 2ND | LAST |
|---|---|---|---|---|
| COORDINATES | y | $y_1$ | $y_2$ | $y_3$ |
| | x | $x_1$ | $x_2$ | $x_3$ |
| P(x, y) | | $P(x_1, y_1)$ | $P(x_2, y_2)$ | $P(x_3, y_3)$ |

LAYOUT REGISTER

| DIVIDED POINTS | DIVIDED COORDINATES | ANGLE |
|---|---|---|
| $D_1$ | $R(x_1, y_1) = P(x_1, y_1)$ | |
| $D_2$ | $R(x_2, y_2)$ | $\theta_1$ |
| $D_3$ | $R(x_3, y_3) = P(x_2, y_2)$ | $\theta_2$ |
| $D_4$ | $R(x_4, y_4)$ | $\theta_3$ |
| $D_5$ | $R(x_5, y_5) = P(x_3, y_3)$ | $\theta_4$ |

1. PICK UP BASE COLOR
2. IF DIVIDER AREA > 0.5 , PUT ONE COLOR
3. IF PILED UP CHANGE COLOR
4. PILED UP nTIMES, PUT nCOLOR

EMBROIDERING SYSTEM AND CONTROL SYSTEM THEREFOR

BACKGROUND OF THE INVENTION

1. Field of the Invention

The present invention relates to an embroidering system, and especially to an embroidering system, an embroidering machine and a control system with a computer to control embroidering data. The computer controls multiple machines independently so that each embroidering machine can stitch different patterns at the same time.

2. Description of the Prior Art

A conventional embroidering machine is shown in U.S. Pat. No. 4,369,722 and Japanese Laid-Open Patent Sho 56-123448 (1982). Japanese Laid-Open Patent Sho 58-22090 (1983) corresponds to U.S. patent application Ser. No. 289,825 filed on Aug. 3, 1981, now U.S. Pat. No. 4,352,334 and shows a system for stitching letters along a curve. U.S. Pat. No. 4,369,722 shows an embroidering system having an embroidering machine. An operator inputs a code assigned to each stitching pattern and machine number into a pattern set board. A magnetic tape which contains stitching data is set on a magnetic tape reader to install stitching data onto a computer memory. The pattern set board indicates a machine number and its input code. The computer reads out the stitching pattern from the memory in accordance with the code. The pattern set board does not indicate the embroidering pattern assigned to each machine.

It is important for an operator that a system shows an embroidering pattern on a CRT display or liquid crystal display when an operator composites, combines or modifies an embroidering pattern on the, computer or when such embroidering pattern is stored onto a hard disk, floppy disk or memory. Further it is better to show a stitching pattern on the display while embroidering machines stitch the patterns. When the computer controls several embroidering machines at one time, all of the patterns currently being stitched must be shown on the display.

On the other hand, an embroidering machine is required to embroider many letter characters which vary in the various languages. It is important for the embroidering machine to have a capability of selecting and arranging letter characters, because some languages have different characters with the same phonetic sound.

Further it is preferable that a embroidering machine can show thread patterns of the characters before the machine actually embroiders when threads or settings are changed.

SUMMARY OF THE INVENTION

Accordingly, one of the objects of the present invention is to provide an embroidering system having an embroidering machine and associated control system to obviate the above mentioned drawbacks.

Another object of the present invention is to provide an embroidering machine and associated control system which can embroider many letter characters, and which can select characters whose phonetic sounds correspond to more than one character.

A further object of the present invention is to provide an embroidering system with an associated control which can show all of the embroidering patterns of plural machines on a display during the embroidering operation of the machines.

Yet another object of the present, invention is to provide an embroidering machine and associated control system which can show thread patterns on a display.

To achieve the above objects, and in accordance with the principles of the invention as embodied and broadly described herein, an embroidering system for embroidering comprises plural embroidering machines. Each embroidering machine has an embroidery frame, a frame motor for moving the frame in X and Y directions, a needle motor for a needle, memory means for storing embroidering data and control means for controlling the frame motor and needle motor in accordance with the embroidering data. An embroidering system further comprises display means, input means having a keyboard and a means for inputting coordinates on a screen of the display and register memory means for storing plural embroidering patterns, image data and embroidering data which includes data for characters of several languages which have different character symbols with the same phonetic sound. An embroidering system further comprises main control means for:

(a) checking a phonetic sound input by the input means to determine whether such phonetic sound corresponds to more than one character, (b) reading image data corresponding to all of the characters which have the same phonetic sound, (c) displaying all of the image data on the display means, (d) selecting a desired character from the displayed characters by using the input means, (e) registering the desired character into the register memory means, and (f) sending embroidering data corresponding to the registered embroidering pattern to the memory means of an embroidering machine.

In accordance with the invention, when an operator inputs the desired language from the input means, the main control means reads the image data which corresponds to the selected language from the register memory. When an operator selects one key on the keyboard, the main control means checks a phonetic sound of that key to determine whether such phonetic sound corresponds to more than one character. If there is more than one character, the main control means reads image data corresponding to all of the characters which have the same phonetic sound and displays all of the image data on the display means. An operator selects a desired character from the displayed characters by using the input means. Then the main control means registers the desired character into the register memory means, and sends embroidering data corresponding to the registered embroidering pattern to the memory means of the embroidering machine. Thus an operator can select many language characters and register them as new embroidering patterns.

Further the main control means of the present invention can display the selected desired character on the display means. After selection of one character, an operator may select an additional character in the same way mentioned above. The main control means can display the additional character onto the same screen on which the first selected character is displayed. Thus an operator can combine the characters while viewing such patterns on the screen and register it as a new pattern.

BRIEF DESCRIPTION OF THE DRAWING

For a full understanding of the true scope of the invention, the following detailed description should be read in conjunction with the drawings, wherein:

FIG. 23 is an image of the codes which correspond to alphabetical letters shown on the display 4.

FIG. 24 is a chart which shows data of the name register which registers file names assigned to a combined pattern.

DETAILED DESCRIPTION OF THE PREFERRED EMBODIMENTS

Figure 1:
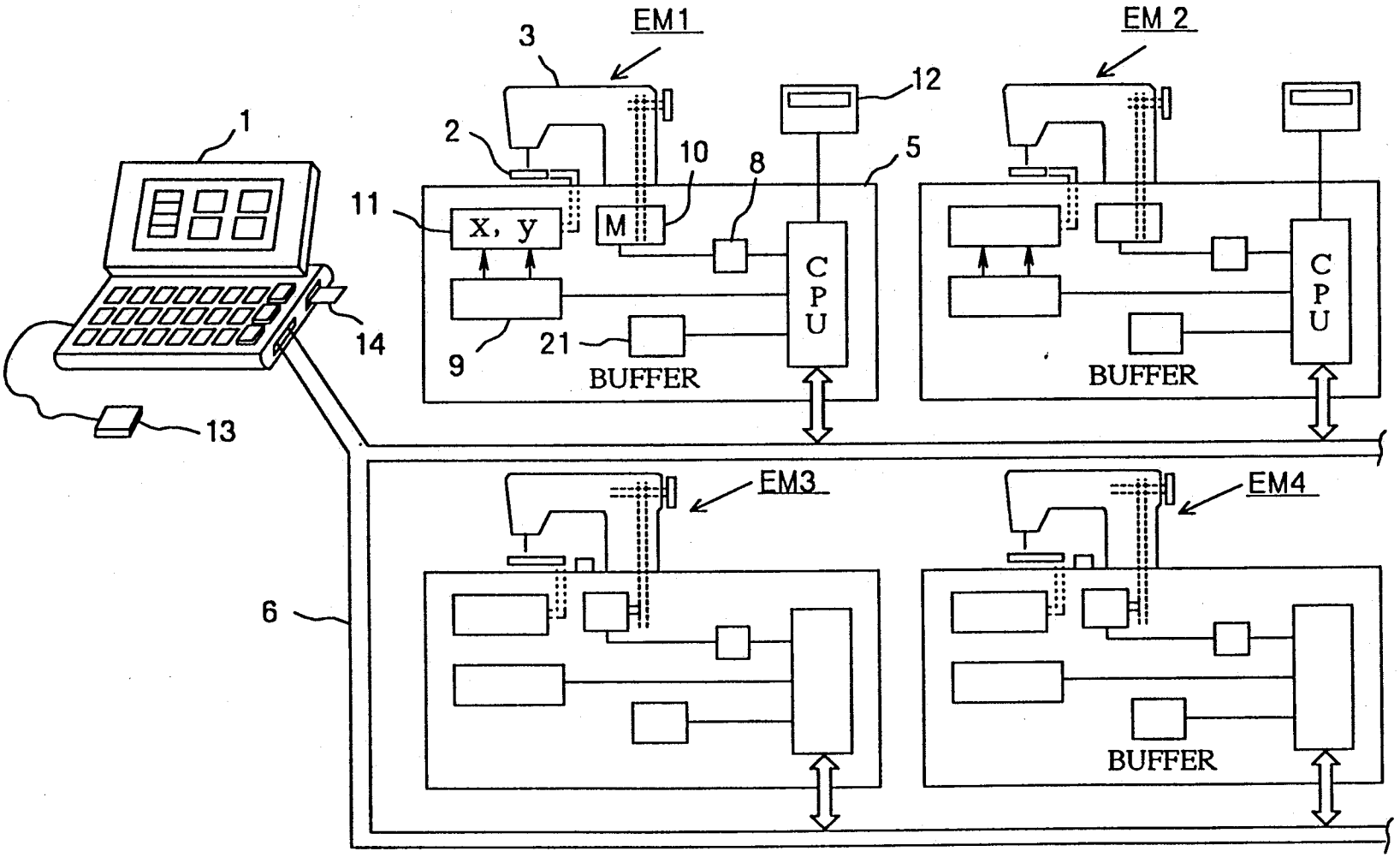
FIG. 1 is a block diagram which shows en exemplary embodiment of an embroidering system for embroidering in accordance with the present invention.
Figure 2:
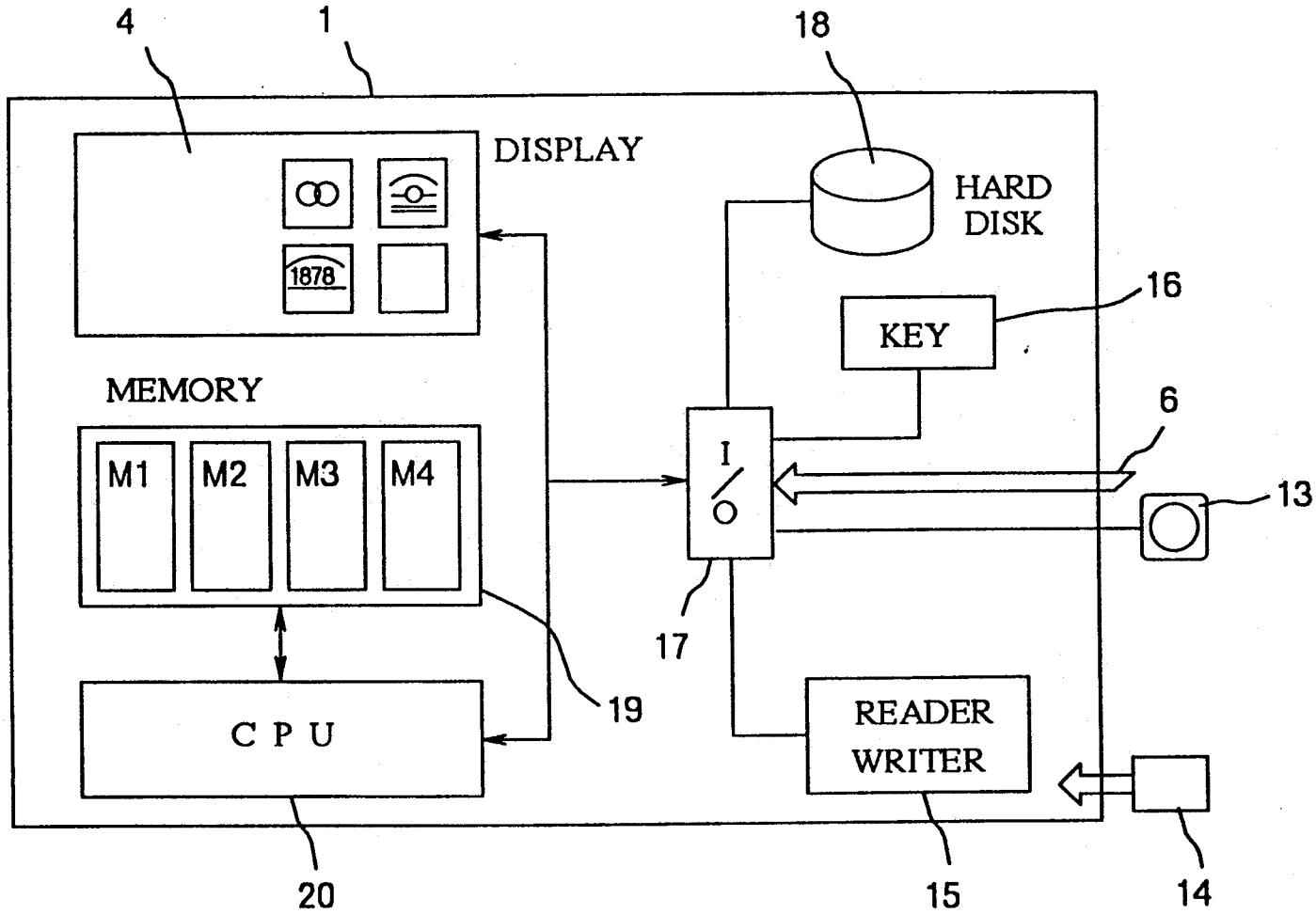
FIG. 2 is a block diagram which shows a controller of the system shown in FIG. 1 of the present invention.

In the following, preferred embodiments of the present invention will be described with reference to the drawings. FIG. 1 shows one embodiment of the present invention. The controller 1 is connected with each of a plurality of embroidering machines EM 1–4 through the data line 6. Referring to FIGS. 1 and 2, a micro processor 7 (hereafter referred to as machine computer 7) of the embroidering machine EM 1 has a control board 12 with a ten key keypad, control keys and a display. When an operator sends signal using the ten key and control keys to the controller 1 to select an embroidering pattern displayed on the display 4, the machine computer 7 requests a micro processor 20 (hereafter referred to as the main computer 20) of the controller 1 for the embroidering data corresponding to the selected embroidering pattern. When an operator operates the key board 16 or the mouse 13 of the controller 1 to transfer the embroidering data, which corresponds to the embroidering pattern, to the embroidering machine EM 1, the main computer 20 sends the embroidering data to the buffer 21 of the embroidering machine EM 1. When the operator operates the start key of the control board 12, the machine computer 7 reads the embroidering data from the buffer memory 21 and controls the X and Y motor driver 9 and the machine driver 8. The embroidering machine EM 1 moves the embroidering frame 2 in X and Y directions by the X and Y motor driver 9 in accordance with the machine computer 7. The machine driver 8 controls the machine motor 10 and the needle mechanism 3 to embroider the patterns.

Other embroidering machines EM 2–4 have the same or similar system and function in a manner similar to the embroidering machine EM 1. In FIG. 1, the controller 1 is connected to four embroidering machines EM 1–4, but the number of the embroidering machines, for example, can be up to eight.

Referring FIG. 2, the controller 1 has the main computer 20, ten keypad, the key board 16 including alphabetical keys and control keys, a color liquid crystal display 4, a mouse 13 to control the cursor on the screen of the display 4, four image RAM memories 19, a disk drive 15, a hard disk 18 and I/O interface 17. A floppy disk 14 is inserted into the slot of the disk drive 15. The main computer 20, stores the initial program which operates when the power is turned on. An embroidering program to be discussed later is stored in a disk so that an operator can copy it onto the hard disk 18 in the controller 1. The image data of the various languages are also provided in disks. Premade embroidering patterns and image data may be provided. In this system the disk drive 15 and the hard disk 18 are memory media which operate similarly, although the process speeds are quite different. The hard disk 18 can access the buffer memory to save temporary data in the buffer memory.

Four RAM memories 19 of the controller 1 collectively represent an image memory for storing image data for the color display 4. Each RAM memory 19 stores one quarter of the screen image. An operator can select the number of divisions in divided screen using, for example, a divisor of either one (no divided screen, one embroidering pattern), four (four-way divided screen, four embroidering patterns) or eight (eight-way embroidering patterns) by using the keyboard 16 or the mouse 13. When a single screen is selected, the image data of the one embroidering pattern is stored in four RAM memories. When the four-way divided screen is selected, each RAM memory stores one of four image data corresponding the four embroidering patterns, correspondingly. When the eight-way divided screen is selected, each RAM memory stores two image data corresponding to the two embroidering patterns. The stored image data is used for displaying the patterns on the display 4.

FIGS. 3 to 15 show the main operations of the exemplary main computer 20 and FIGS. 16 to 22 show the screen images on the display 4.

Figure 3:
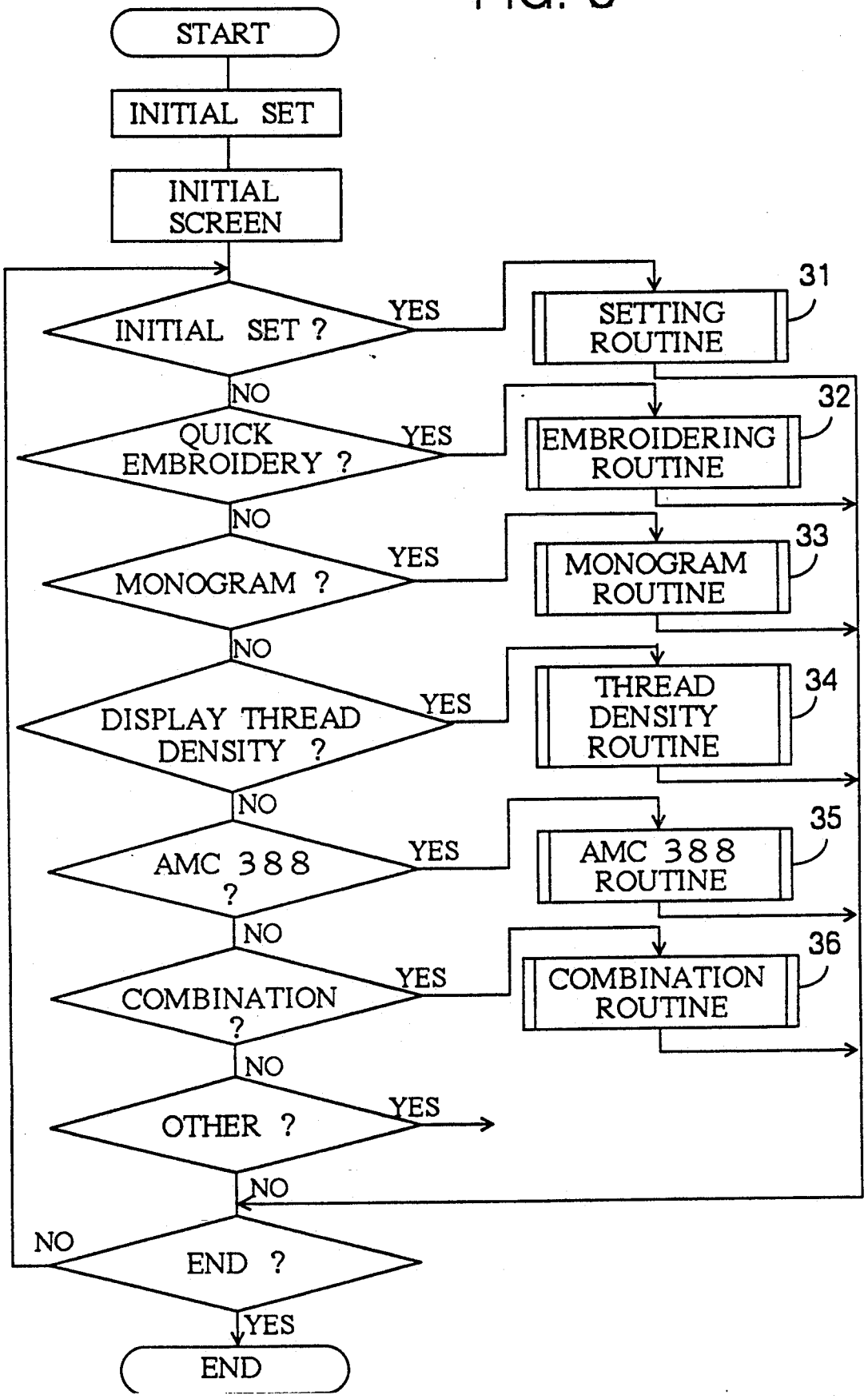
FIG. 3 is a flow chart which shows an operation of the main computer 20 shown in FIG. 2.
Figure 16:
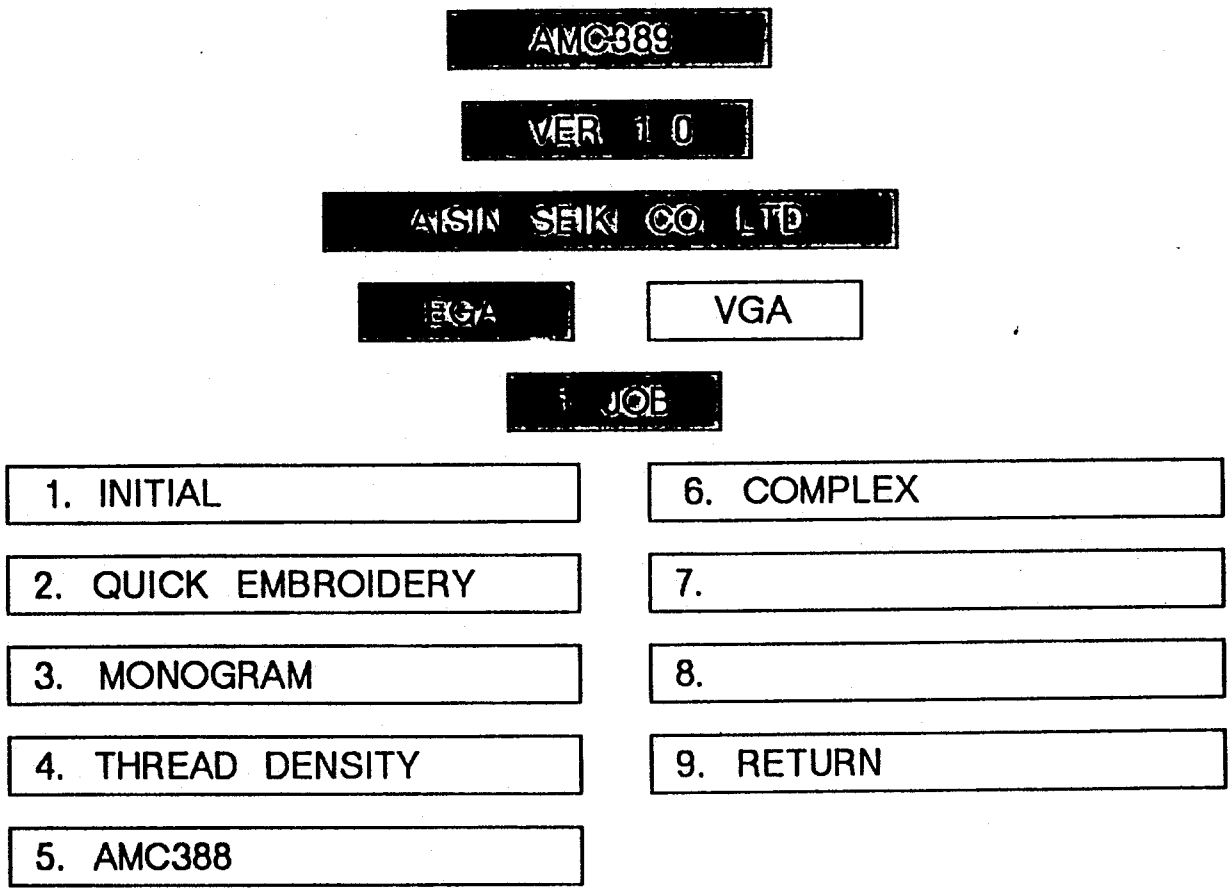
FIG. 16 is an image on the display 4 shown in FIG. 2 when the controller 1 operates in accordance with "initial display" shown in FIG. 3.
Figure 17:
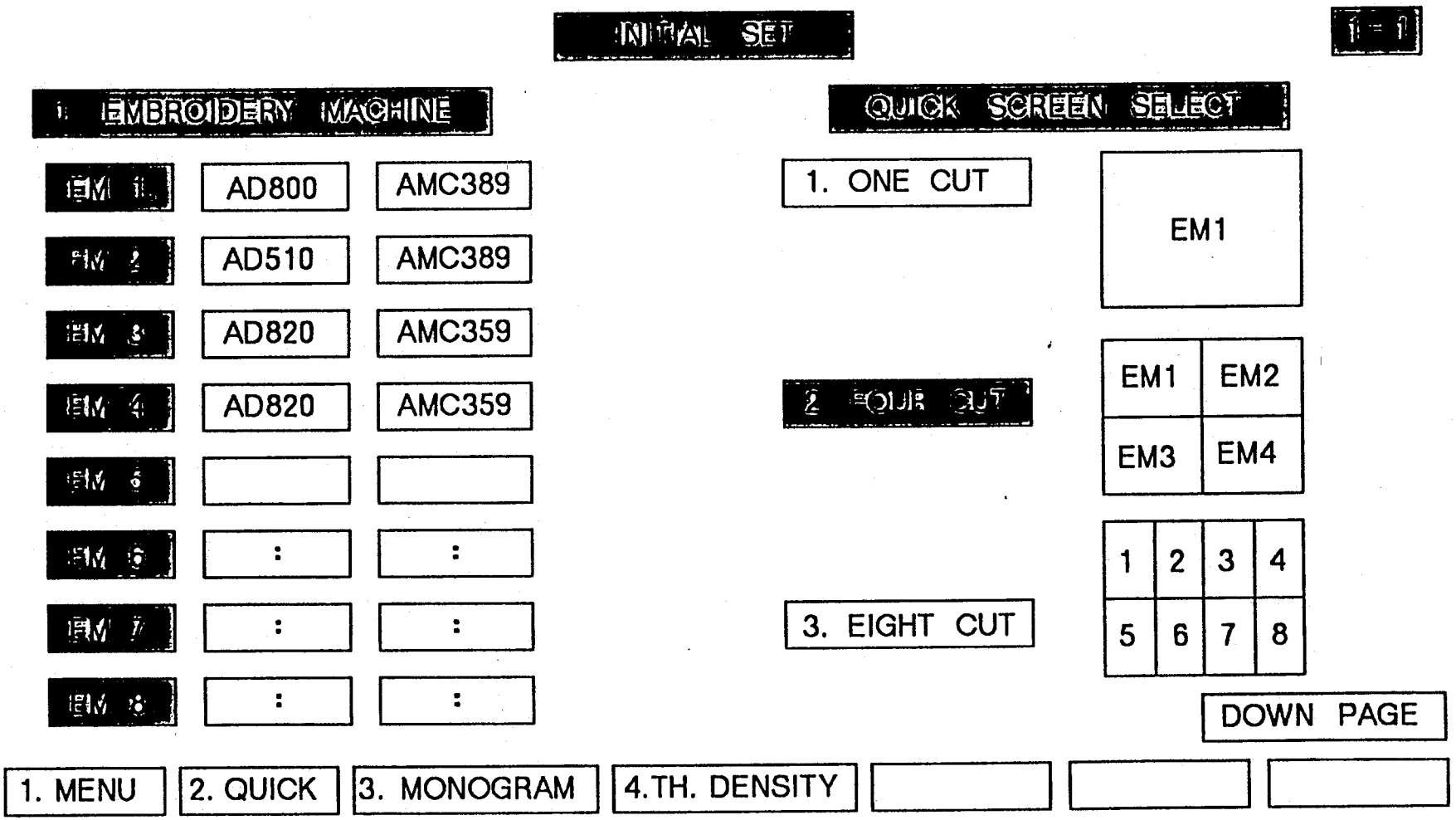
FIG. 17 is an image on the display 4 in accordance with the signals sent by the controller 1.
Figure 18:
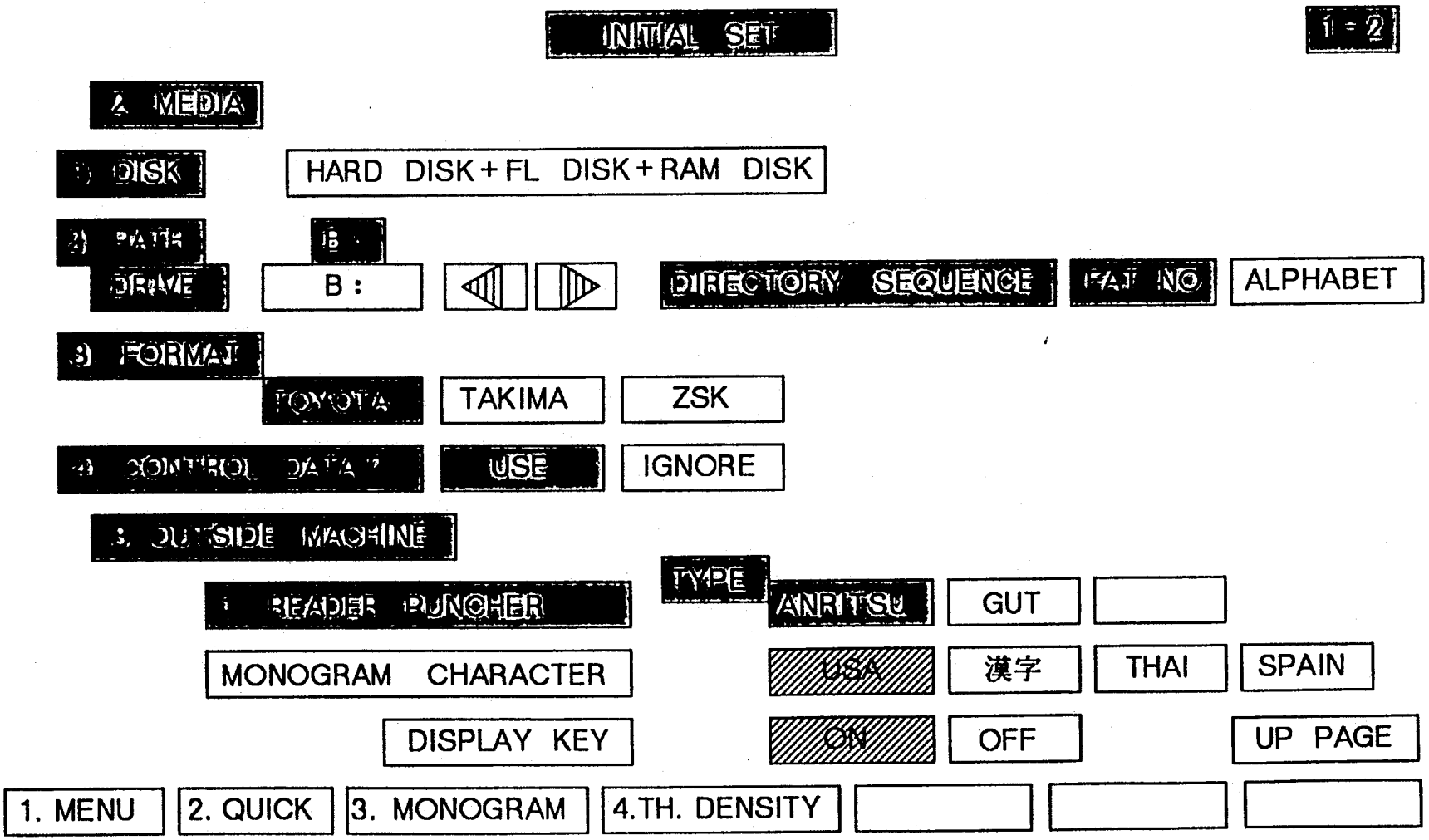
FIG. 18 is an image on the display 4 in accordance with the signals sent by the controller 1.

When the power is on, the main computer 20 executes the initial program stored in the main computer 20. The main computer 20 reads out the embroidering program as shown in FIG. 3 from the hard disk. The main computer 20 displays the initial menu as shown in FIG. 16 on the display 4 in accordance with the initial screen set in the program shown in FIG. 3. When the keyboard 16 or the mouse 13 indicates "1. INITIAL" is to be operated from the initial menu, the main computer 20 executes the "set routine" 31 of the program. The set routine 31 sends the screen image as shown in FIG. 17 to the display 4. This screen shows "1. ONE CUT", "2. FOUR CUT" and "3. EIGHT CUT". In this FIG. 17, "2. FOUR CUT" is selected and the machine data of the four embroidering machines EM 1–4 are displayed. When the "DOWN PAGE" is operated, the main computer 20 displays the image as shown in FIG. 18 on the display 4. The screen shown in FIG. 18 is for an operator to select a recording medium from the hard disk 18 or the floppy disk drive 14, to select data format, to select types of the embroidering machine and to select a language of the embroidering pattern. When the "1. MENU" is selected from the screen shown in either FIGS. 17 or 18, the main computer 20 displays the initial menu screen shown in FIG. 16 on the display 4. The parameters set according to the screens shown in FIGS. 17 and 18 are changeable during operation.

Figure 4:
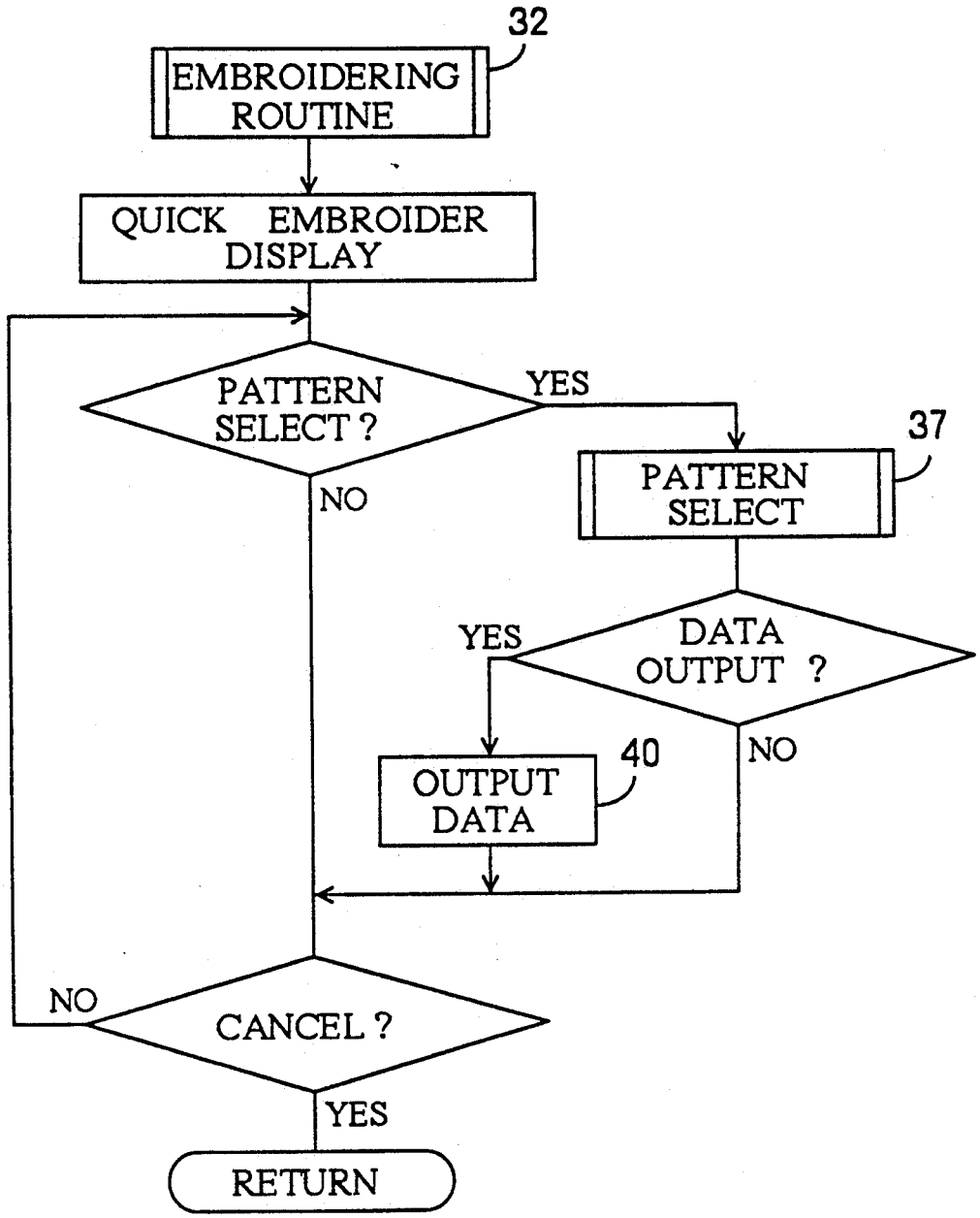
FIG. 4 is a flow chart which shows an operation of the "embroidering routine" 32 shown in FIG. 3.
Figure 5:
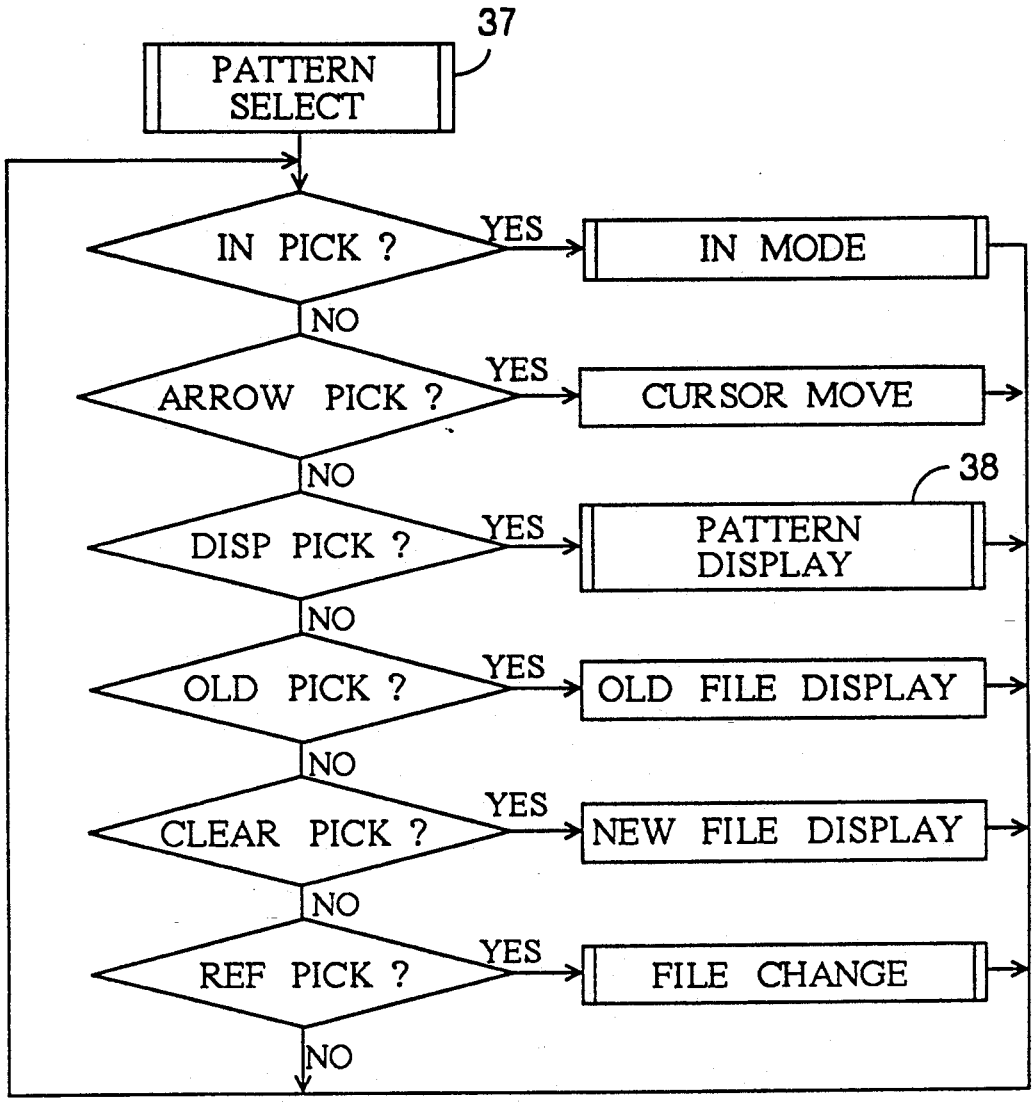
FIG. 5 is a flow chart which shows an operation of pattern select 37 shown in FIG. 4.
Figure 6:
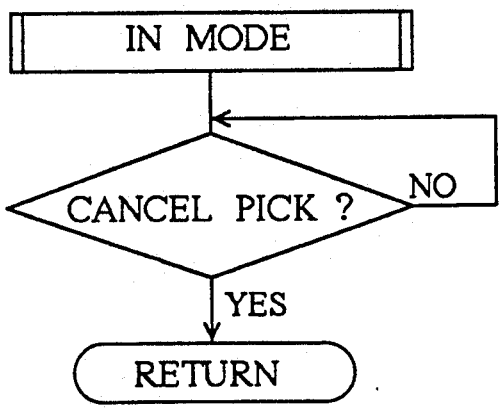
FIG. 6 is a flow chart which shows an operation of "In Mode" shown in FIG. 5.
Figure 7:
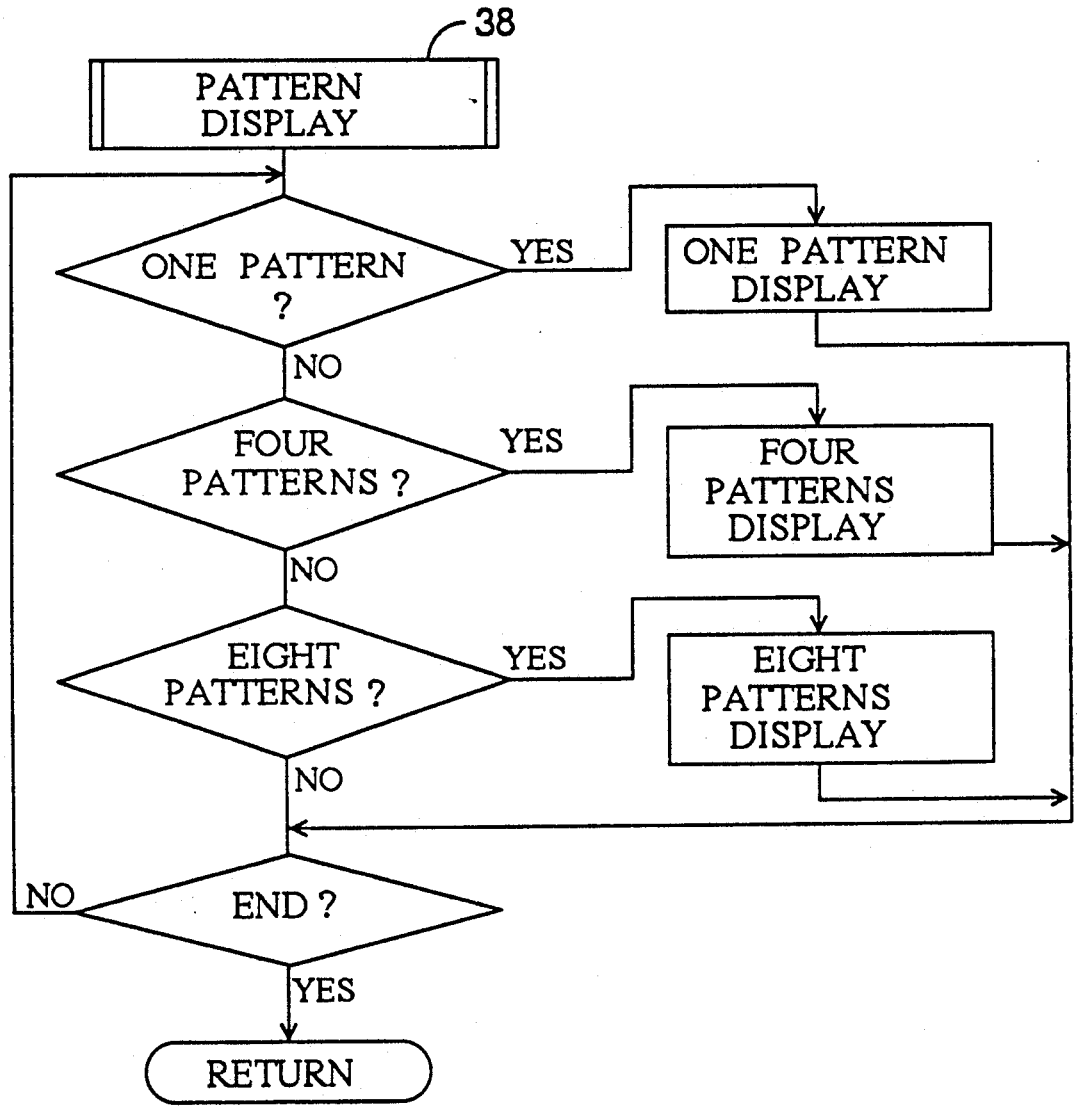
FIG. 7 is a flow chart which shows an operation of "display" 38 shown in FIG. 5.
Figure 8:
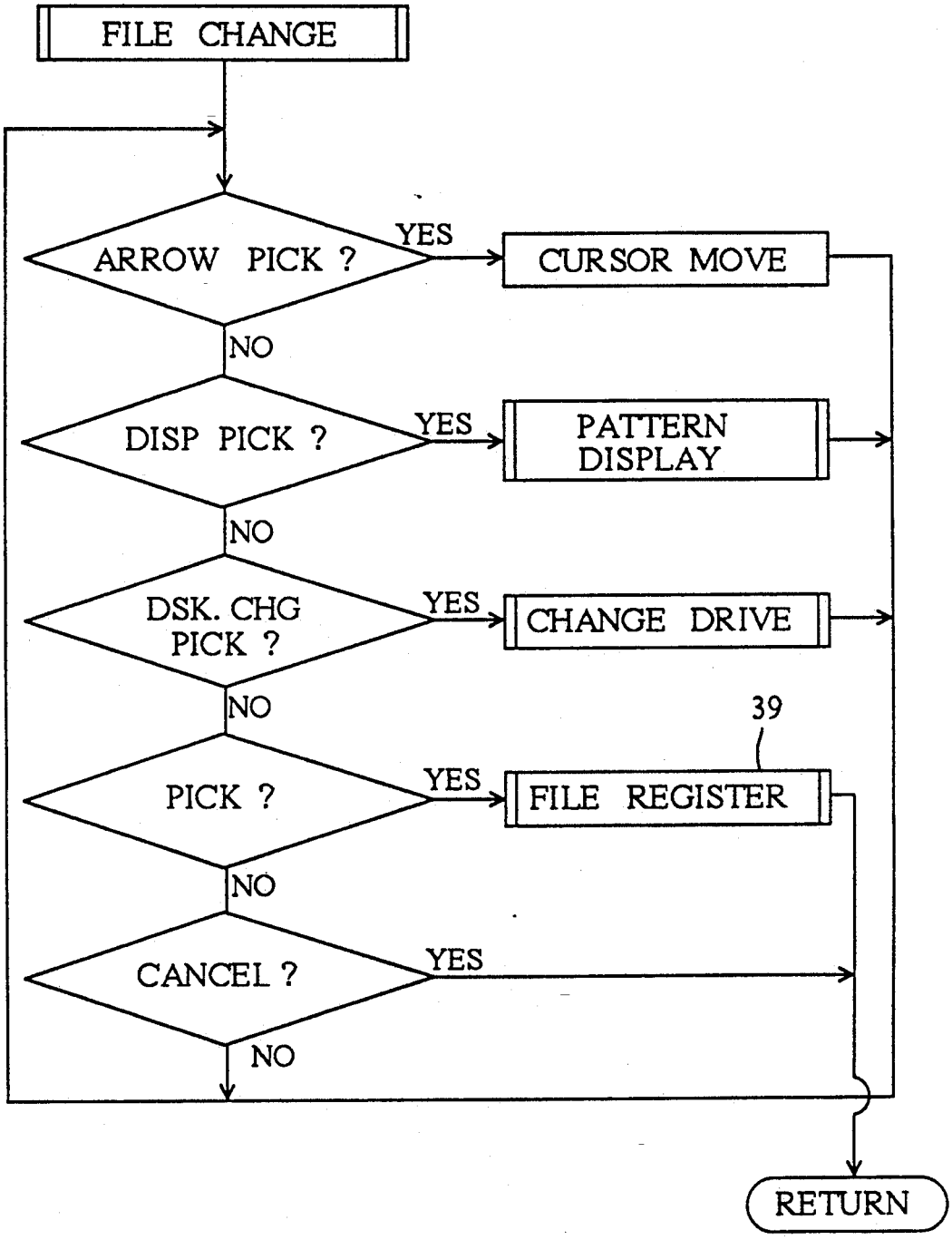
FIG. 8 is a flow chart which shows an operation of "file change" shown in FIG. 5.
Figure 9:
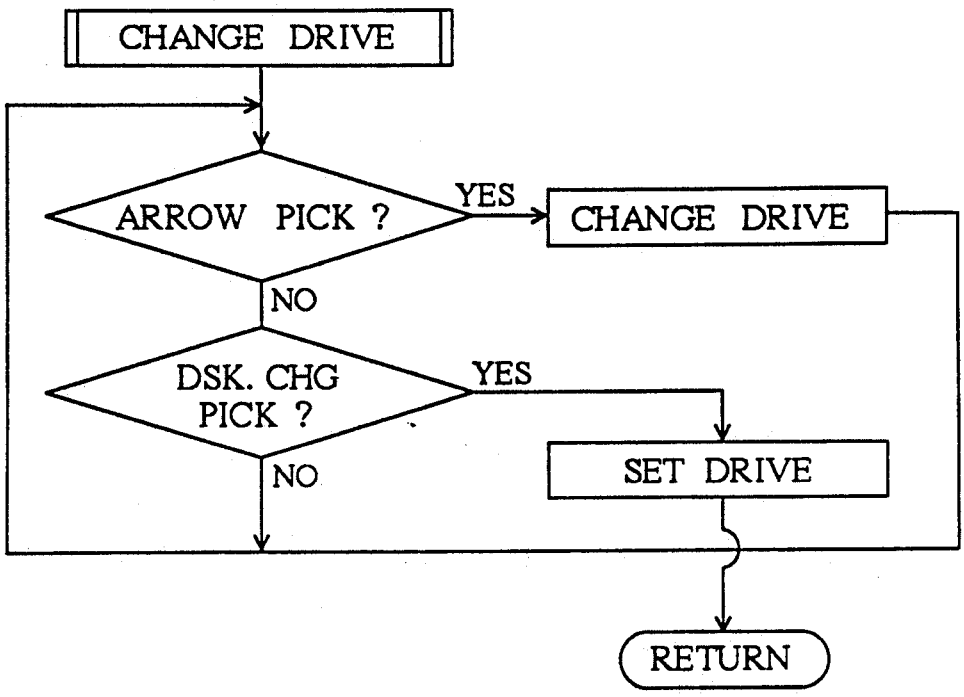
FIG. 9 is a flow chart which shows an operation of drive shown in FIG. 8.
Figure 10:
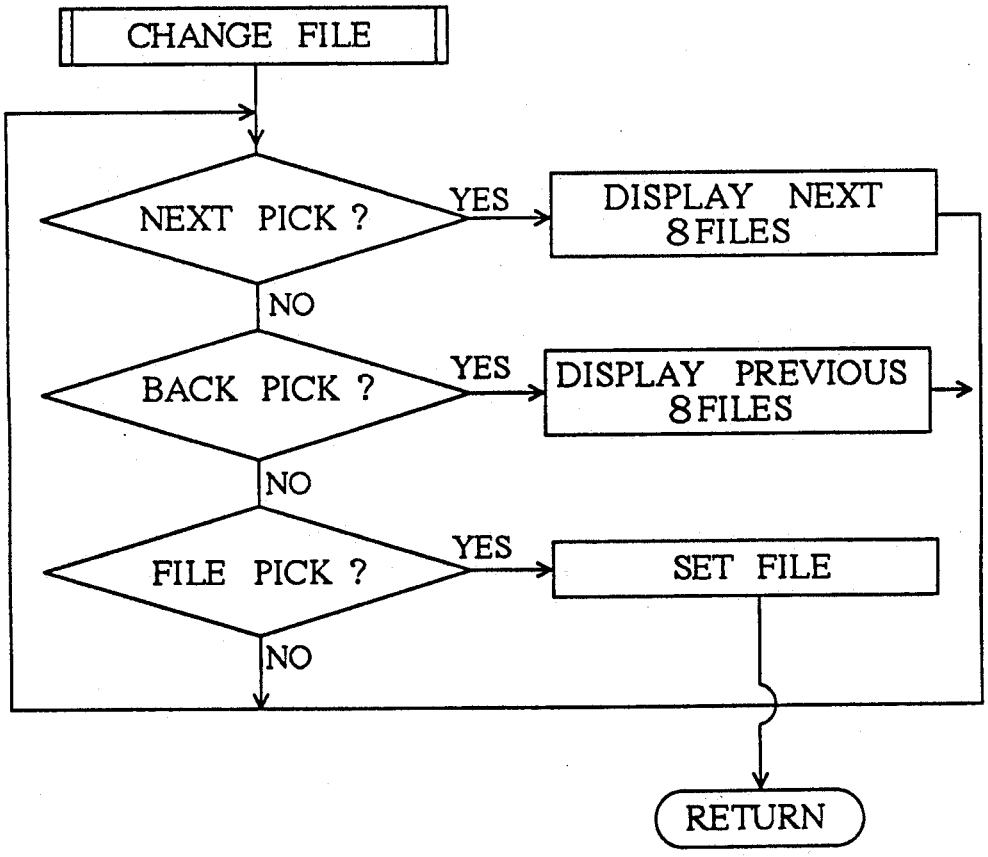
FIG. 10 is a flow chart which shows an operation of file shown in FIG. 8.

When an operator selects the "2. QUICK EMBROIDERY", the main computer 20 executes the "embroidering routine" 32 as shown in FIG. 4. First the quick embroidery screen is displayed on the display 4. When the "select pattern" is selected, the main computer 20 executes the select pattern routine 37 and displays the pattern select menu on the screen. FIGS. 5 to 8 show the operations of the pattern select routine. The main computer 20 reads the data selected by an operator such as the file name to save the pattern and the pattern image and data designated by such file name and writes the data into the hard disk 18 when the "FL Disk" is selected in the setting routine 31. When an operator selects the "DISP" from the screen shown in FIG. 19, the main computer 20 executes the pattern display 38 in FIG. 7 to display the pattern on the display 4. When the "control data ?" is selected with "IGNORE" in the setting routine 31, the main computer 20 ignores the data and does not write the data into the hard disk 18. When the "Disk" is selected with the "HARD DISK" in the setting routine 31, the main computer 20 reads the embroidering pattern data from the hard disk 18 in the setting routine 31. The main computer 20 executes the pattern display 38 in FIG. 7 when an operator selects the "DISP".

Figure 19:
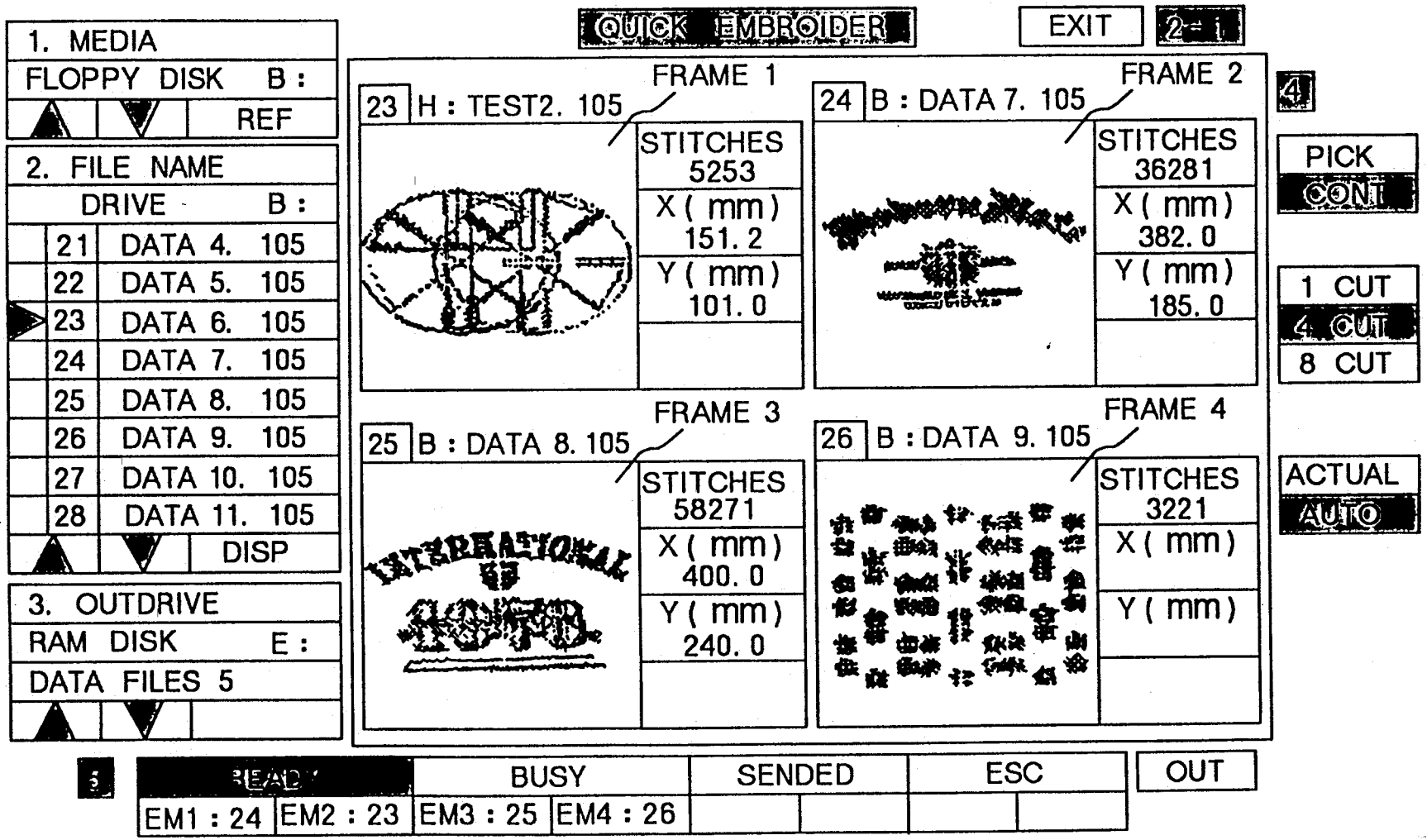
FIG. 19 is an image on the display 4 in accordance with the signals sent by the controller 1.

FIG. 19 shows the screen of the display 4 when the four-way divided screen is selected and the pattern selection 37 and the pattern display 38 are executed. Two triangles shown in the "1. MEDIA" of the display screen indicate that an operator can select the recording media from either the hard disk 18 or the floppy disk 14. When an operator selects one of the triangles, the recording media display changes from the hard disk to the floppy disk or the contrary. FIG. 19 shows that the eight file names are selected in the "2. File Name".

An operator selects the EM 1 at the bottom of the screen shown in FIG. 19 and operates the cursor up or down to select 24 so that the file name display at the bottom of FIG. 19 shows the file name 24 to be selected. In the same manner, an operator selects the file names 23, 25 and 26 for EM 2, 3 and 4, selectively. The embroidering data corresponding to the file names are sent to the embroidering machines EM 1–4 to store the data into the buffer memories 21. An operator can select a file name by using the operation board equipped with each embroidering machine. When an operator inputs the file name 24 from the operation board 12 of the embroidering machine EM 1 and operates the key to request the data, the machine computer 7 sends a request for the data selected by the file name 24 to the controller 1. The main computer 20 responds to the request and reads the embroidering data corresponding to the file name 24 from the hard disk 18.

When an operator inputs the start signal from the operation board 12 of the embroidering machine EM 1, the machine computer 7 of the embroidering machine EM 1 controls the X, Y motor driver 9 in accordance with the data in the buffer memory 21. The machine computer 7 also controls the machine driver 8 in synchronism with the X, Y driver 9. The embroidering is made onto the cloth in the frame 2. The other embroidering machines EM 2, 3, 4 operate in the same manner with the embroidering machine EM 1. When the embroidering machine finishes the embroidering, the machine waits for next instructions.

Figure 20:
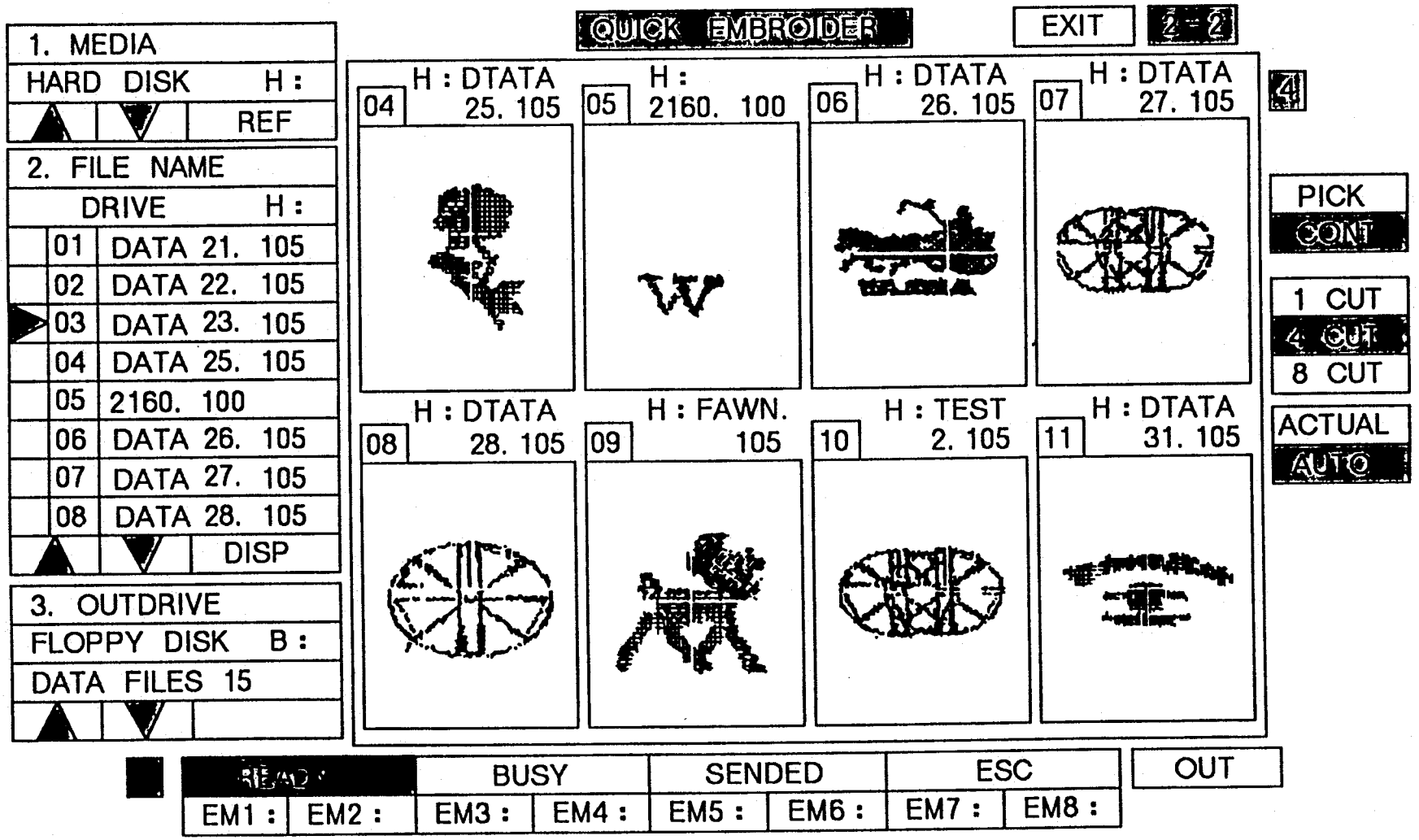
FIG. 20 is an image on the display 4 in accordance with the signals sent by the controller 1.

FIG. 20 shows the screen display for an eight-way divided screen mode when the pattern display 38 is executed. The number of divisions of the divided screen can be changed by selecting either "1 Cut", "4 Cut" or "8 Cut" from the screen. When an operator selects "OUT" from the screen, the main computer 20 changes the screen display to the initial display shown in FIG. 16.

Figure 31:
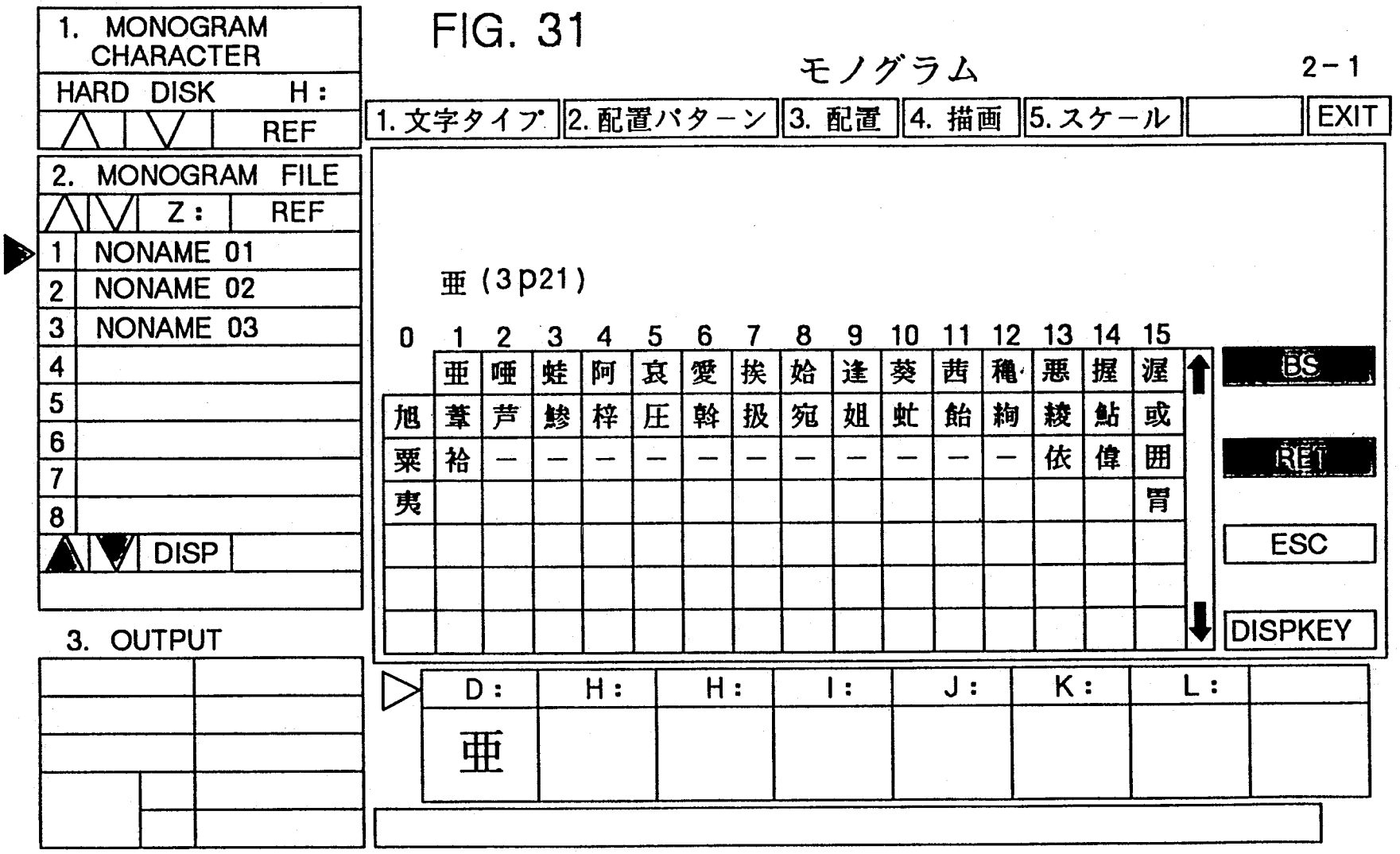
FIG. 31 is an image on the display 4 in accordance with the signals sent by the controller 1 shown in FIG. 2.

When an operator selects "3. MONOGRAM" from the initial display shown in FIG. 16, the main computer 20 executes the monogram routine 33 shown in FIG. 11. The main computer 20 displays the screen shown in FIG. 21. In this embodiment, the alphabetical keyboard is displayed. When the "MONOGRAM CHARACTER" is set to "Japanese Kanji", the main computer 20 displays the Japanese Kanji display on the screen. When the "CHARACTER" shown in FIG. 31 is selected, the main computer 20 changes the screen to the keyboard selecting screen. If "USA" is selected from this screen, the main computer 20 displays the screen shown in FIG. 21.

Figure 21:
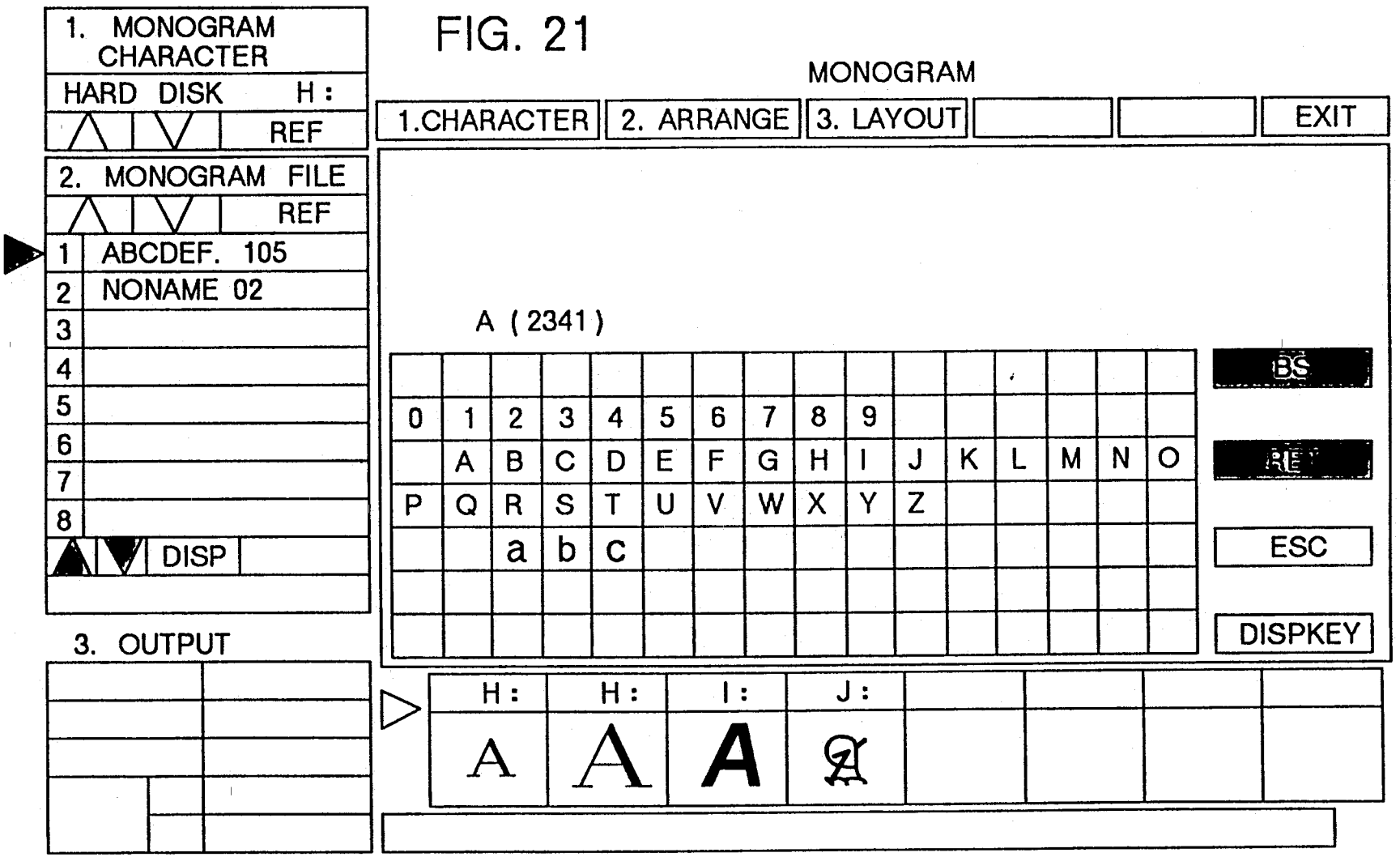
FIG. 21 is an image on the display 4 in accordance with the signals sent by the controller 1.
Figure 22:
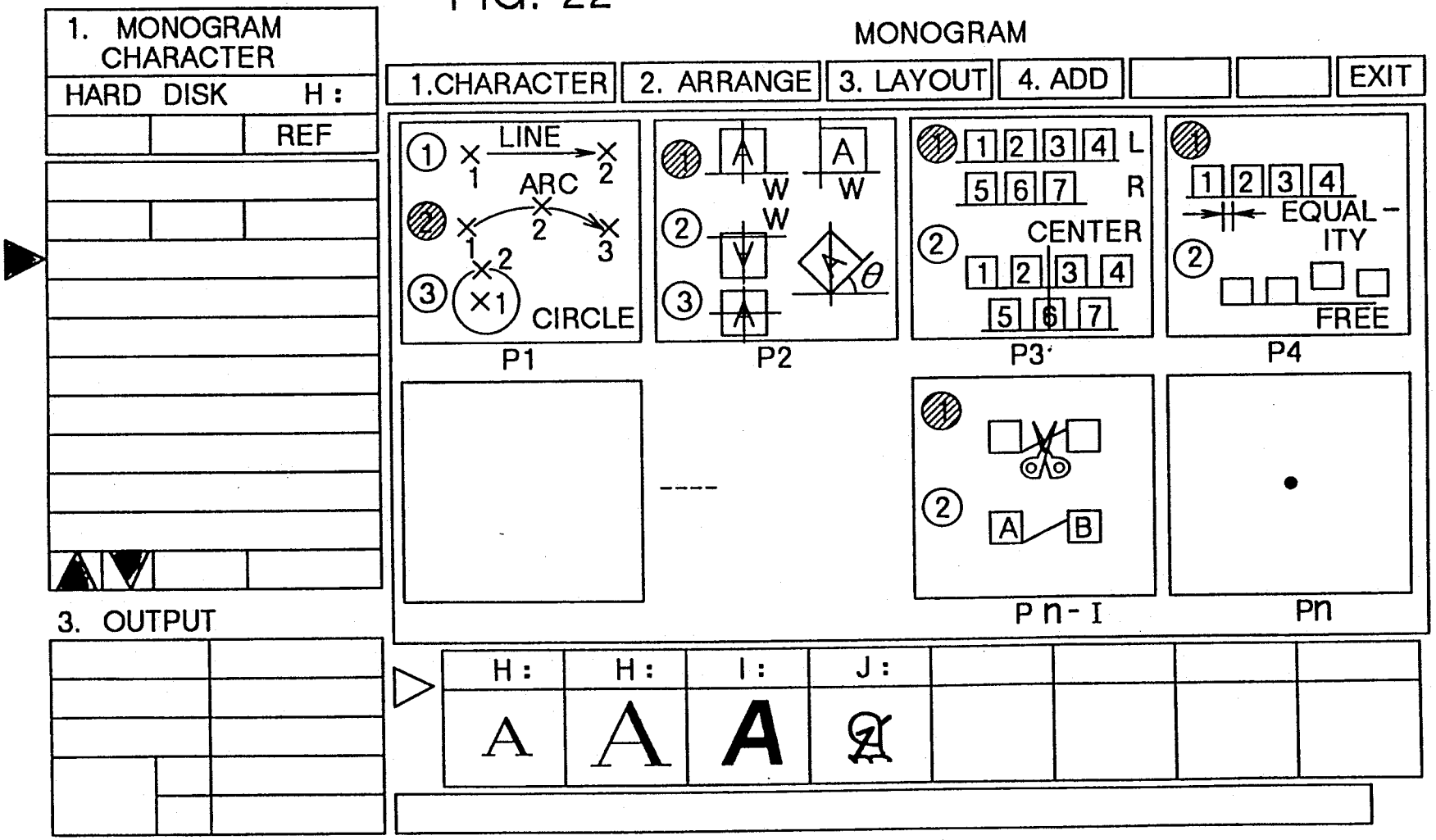
FIG. 22 is an image on the display 4 in accordance with the signals sent by the controller 1.
Figure 25:
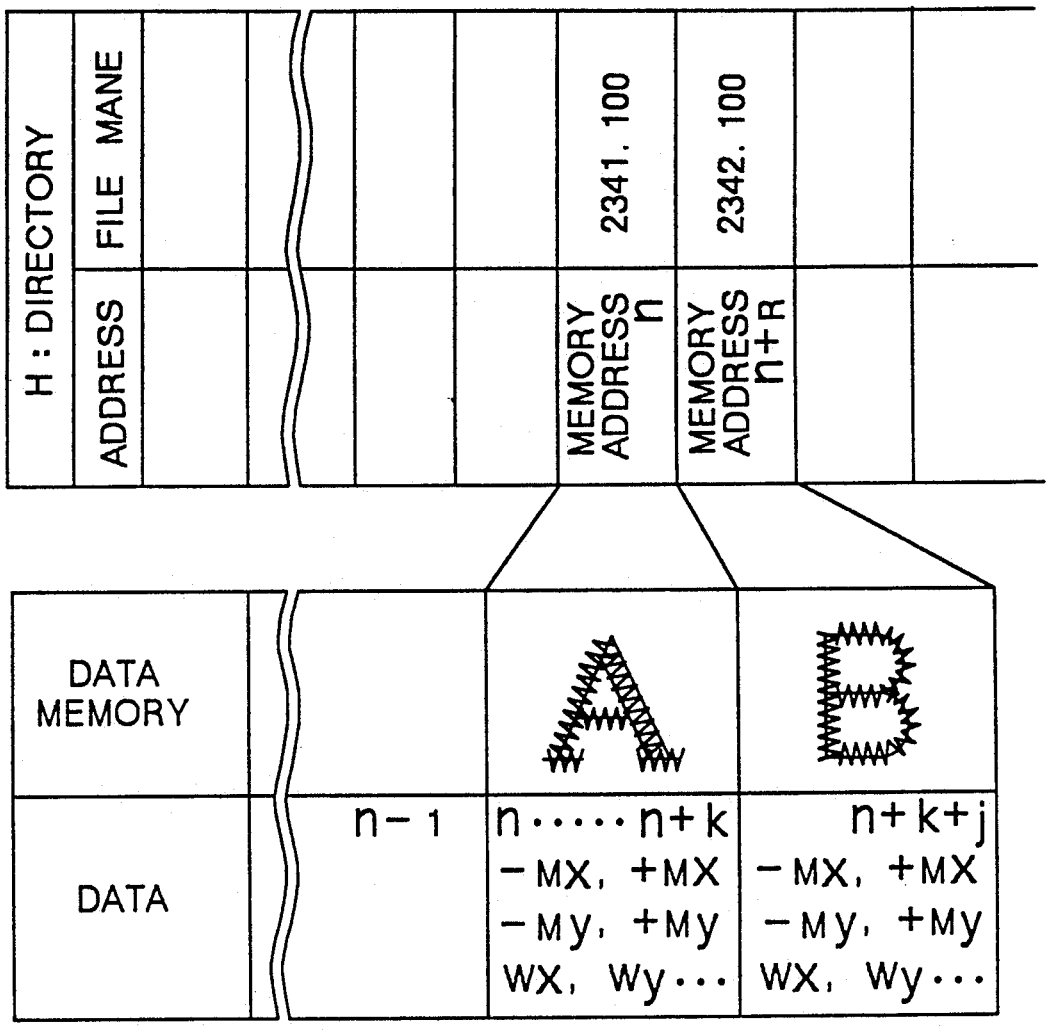
FIG. 25 is a chart which shows a relation between the codes of alphabetical characters displayed on the display 4 and stitch data.
Figure 30:
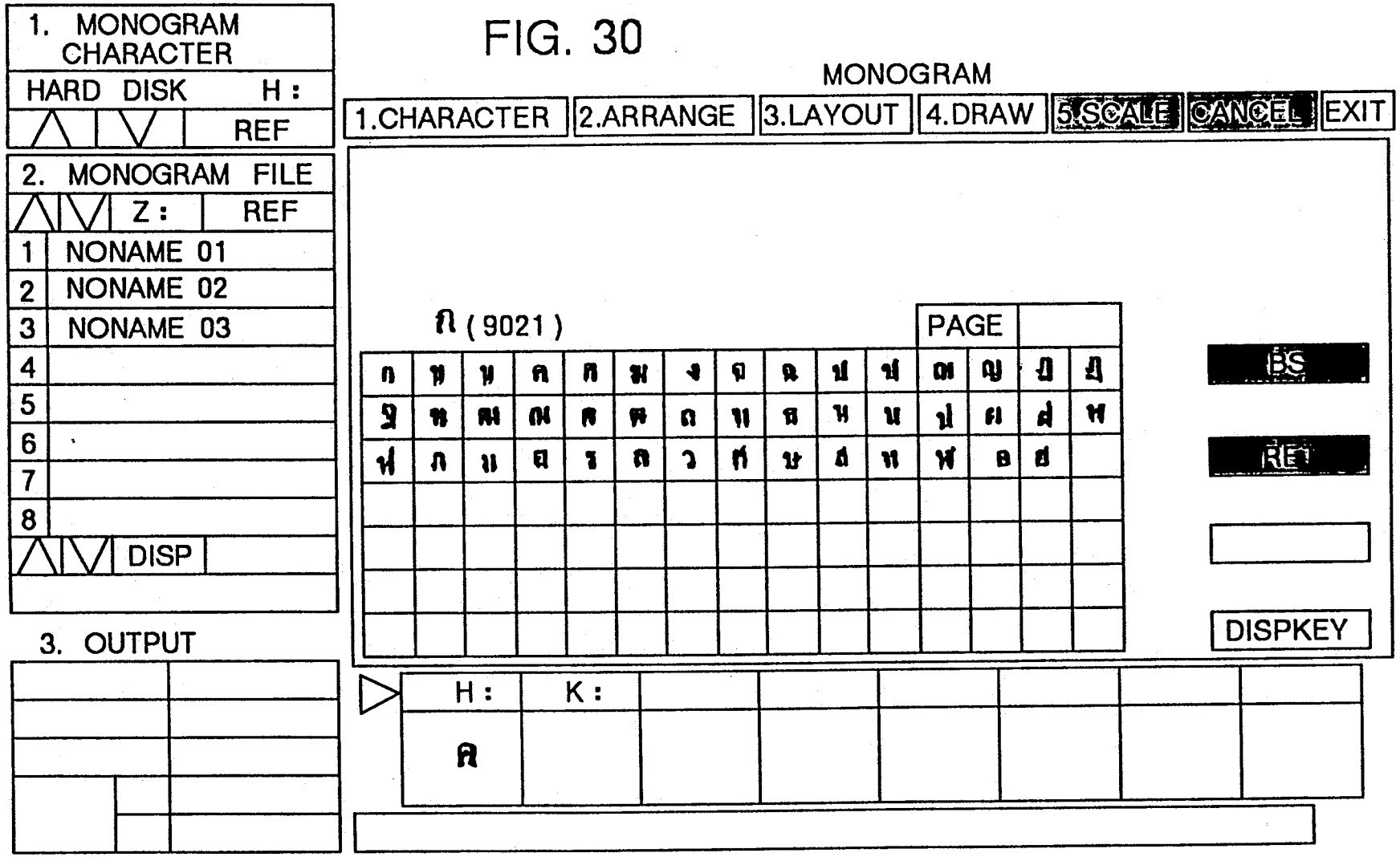
FIG. 30 is an image on the display 4 in accordance with the signals sent by the controller 1 shown in FIG. 2.

The keyboard screens shown in FIGS. 21, 30, 31 are standard characters. For example, the Japanese language has different characters for which pronunciation is the same. If an operator selects "A" key in the keyboard, the main computer 20 displays other characters for which pronunciation is same as the "A" character, as shown in FIG. 21. An operator selects the correct character from the display. The main computer 20 registers the code corresponding to the selected character in the name register shown in FIG. 24. In this process one character is selected. Each character has its own assigned code, for example, "A" is assigned to the code "2341" and "B" is assigned to the code "2342". An operator inputs desired characters into the name register. The embroidering data shown in FIG. 25 is stored in the hard disk 18 so that the main computer 20 can read the embroidering data corresponding to the selected character and write it with the character code into the name register.

Figure 13:
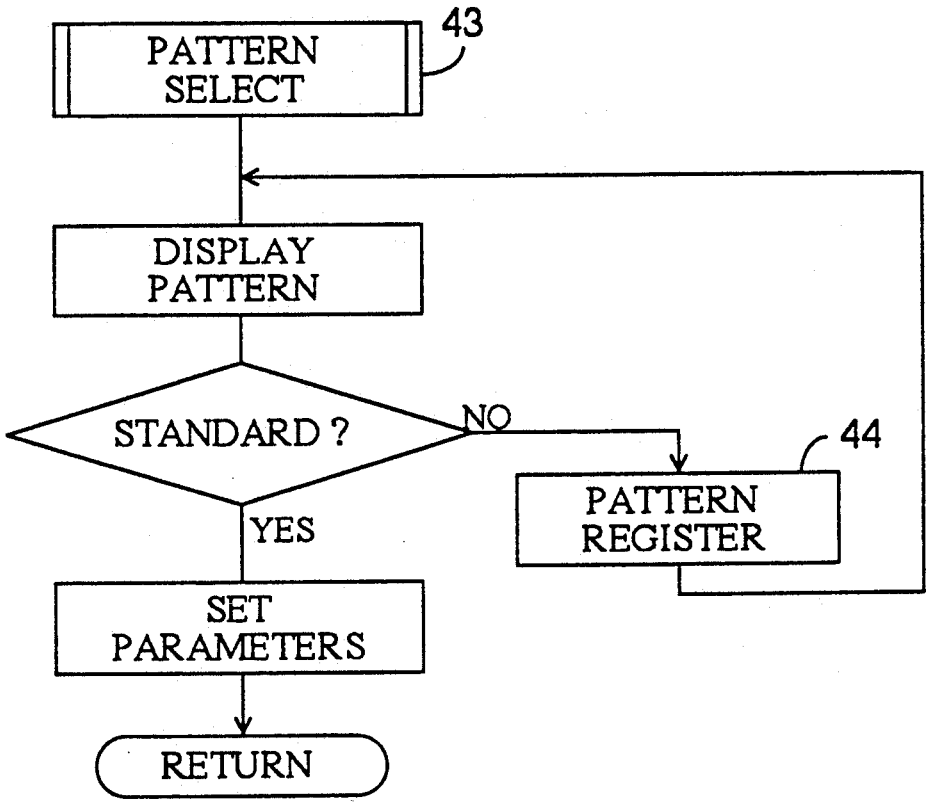
FIG. 13 is a flow chart which shows an operation of pattern select 43 shown in FIG. 11.

After input of one character, an operator selects "2. ARRANGE" in FIG. 21 or 31. When "2. ARRANGE" in FIG. 21 is selected, the main computer 20 executes the select pattern routine 43 in FIG. 1. FIG. 13 shows the operation of the select pattern 43. The main computer 20 displays the pattern registered in the hard disk 18. If there is no desired pattern in the registered patterns, an operator selects "Register Special Pattern" 44 as shown in FIG. 13 to register a new pattern. An operator sets the embroidering parameters in "Parameter Set" in FIG. 13 such as "3. LAYOUT". When "3. LAYOUT" is selected, the main computer 20 executes "display arrangement mode" 46 in FIG. 11 to display the screen shown in FIG. 28. When an operator inputs the three points to arrange the letters along with a curve, the main computer 20 executes "input points" 47 in FIG. 11 to calculate relative coordinates P(x,y) of the coordinates indicated in the scales SX, SY and saves them in the memory as shown in FIG. 33.

Figure 11:
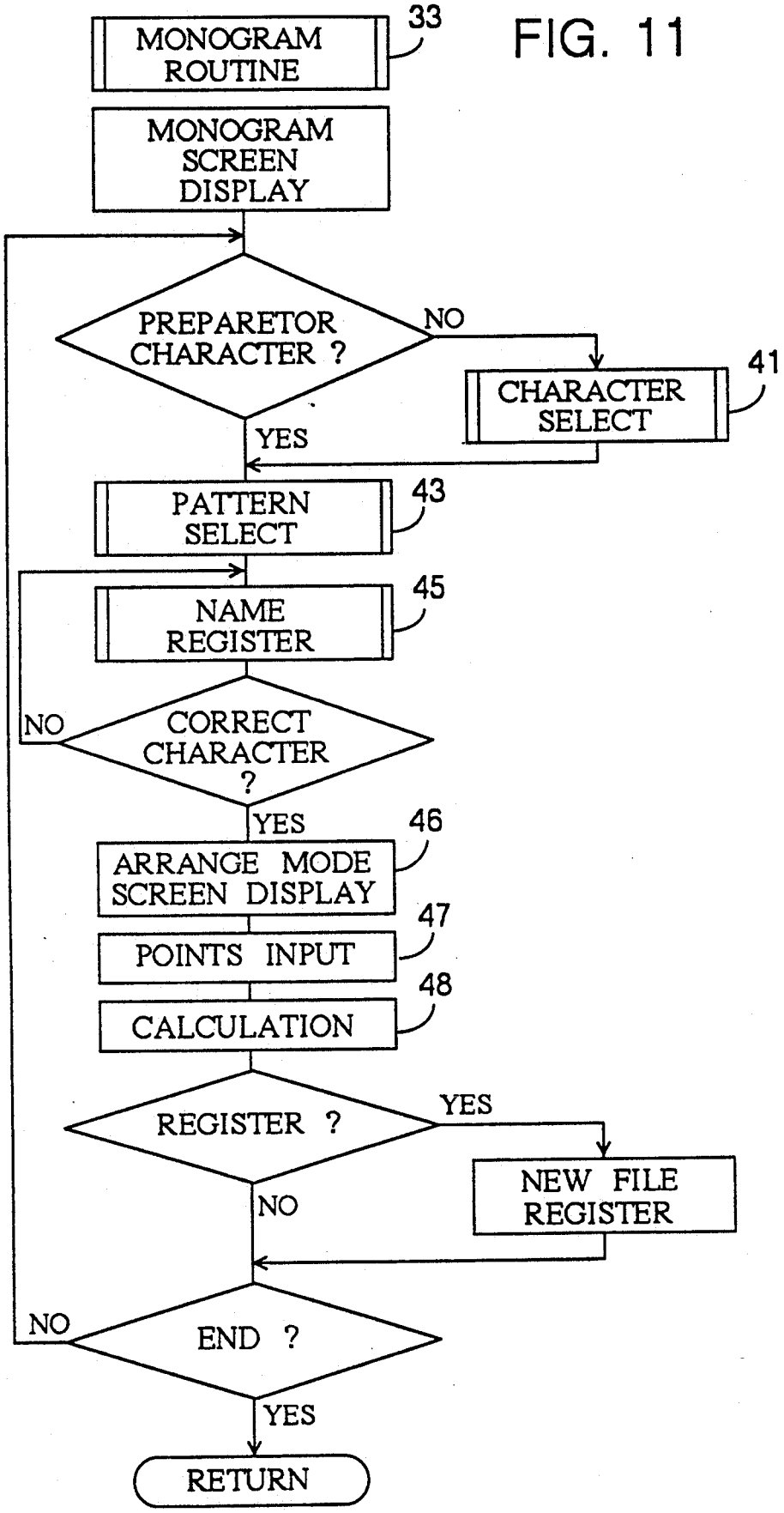
FIG. 11 is a flow chart which shows an operation of "monogram routine" 33 shown in FIG. 3.
Figure 12:
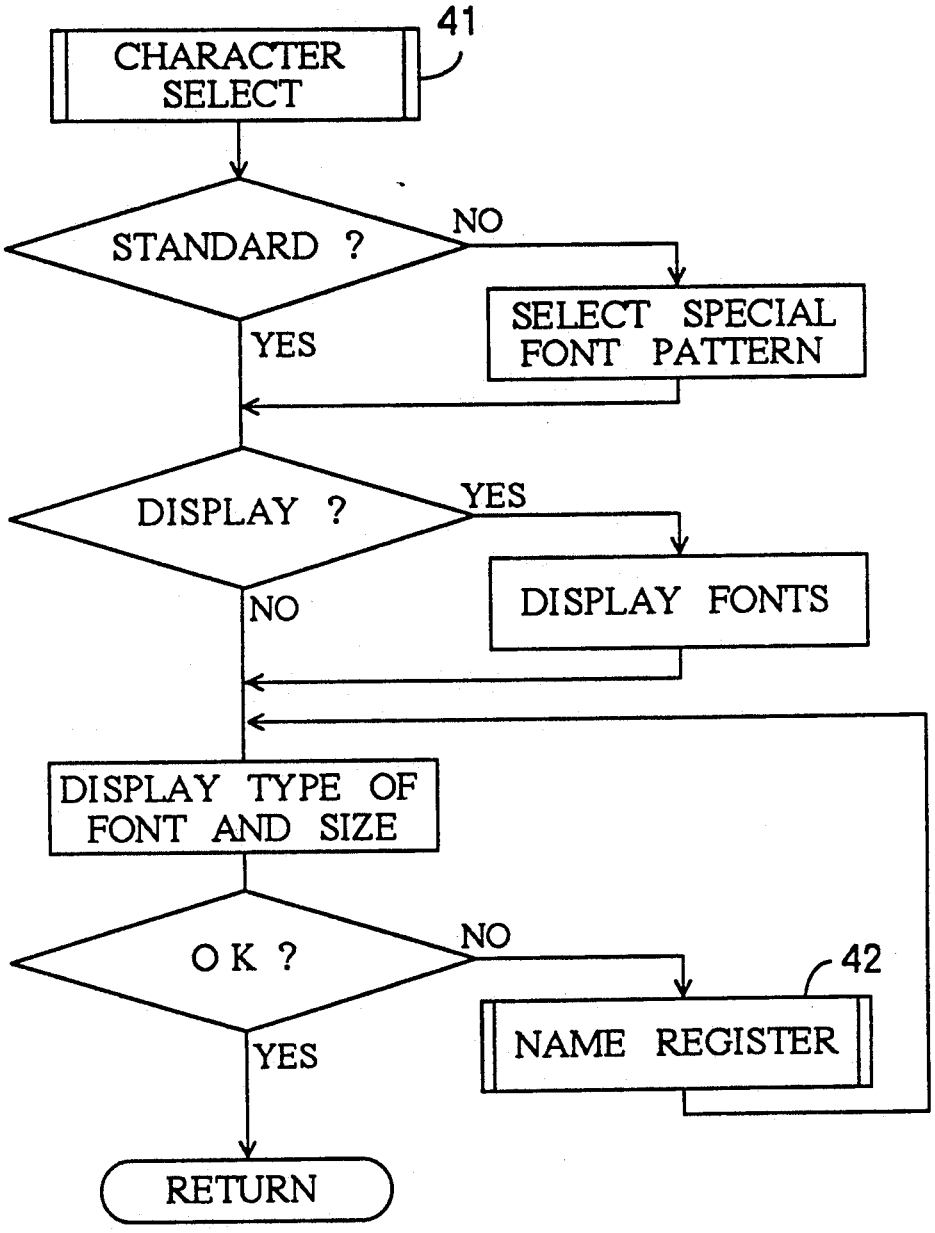
FIG. 12 is a flow chart which shows an operation of character select 41 shown in FIG. 11.
Figure 28:
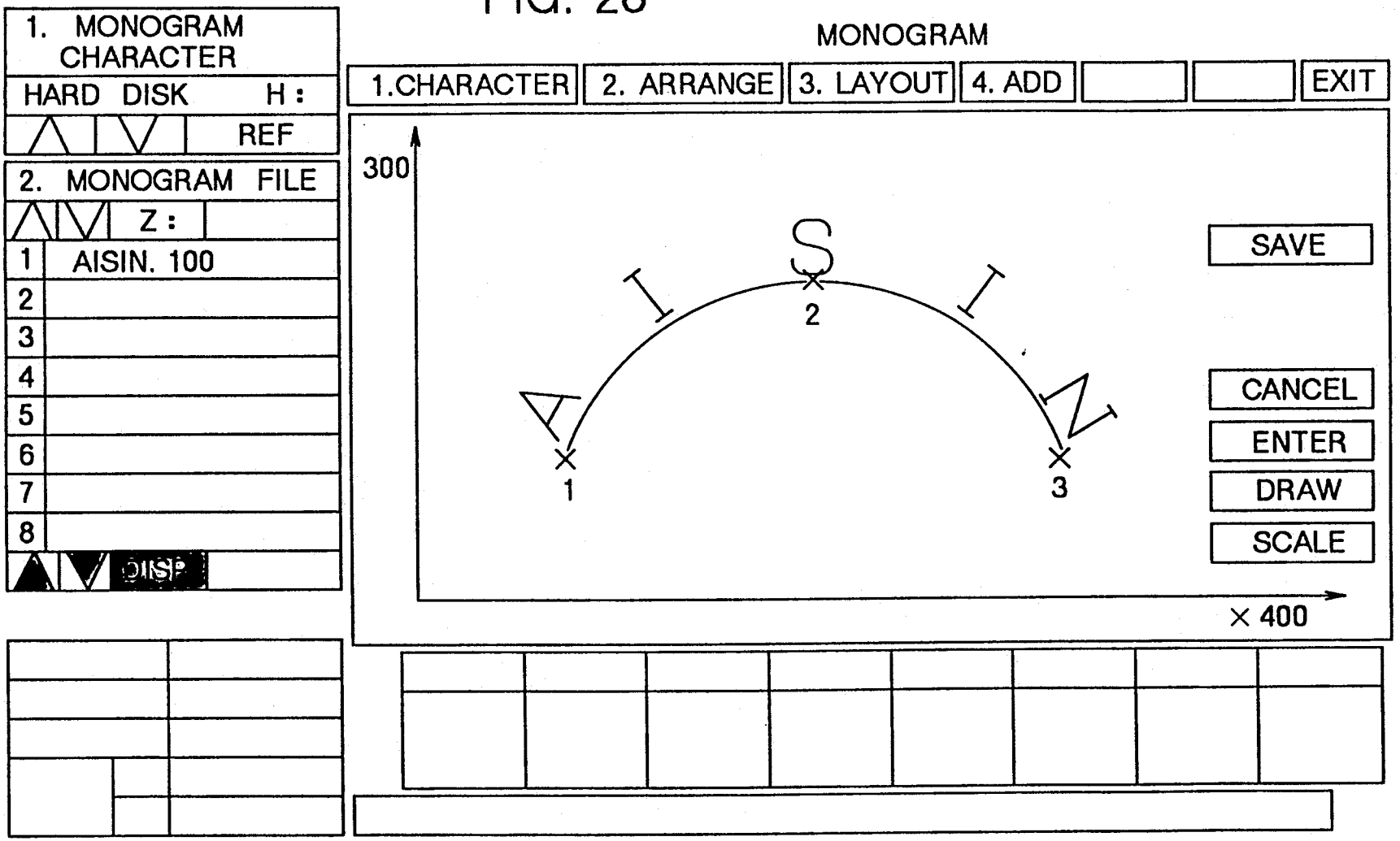
FIG. 28 is an image on the display 4 in accordance with the signals sent by the controller 1 shown in FIG. 2.
Figure 29:
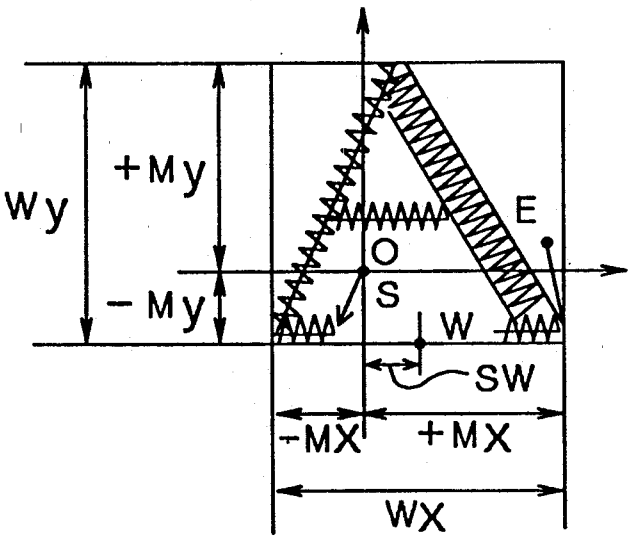
FIG. 29 is an image of characters on the display 4 which are combined in combination routine 36 shown in FIG. 3.
Figure 29:
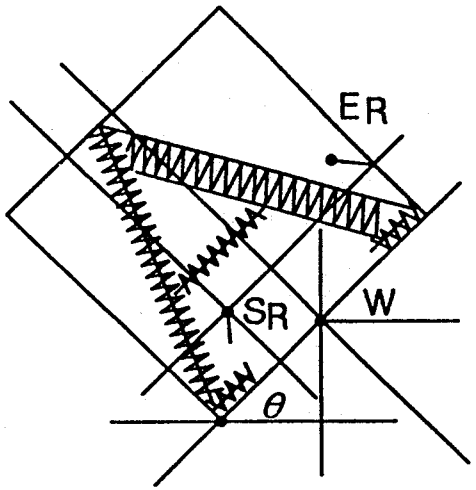

When an operator finishes inputting all desired letters such as "AISIN" and inputs "DRAW" in the screen as shown in FIG. 28, the main computer 20 executes "calculate arrangement" 48 in FIG. 11 to display the arrangement "AISIN" as shown in FIG. 28.

Figure 26:
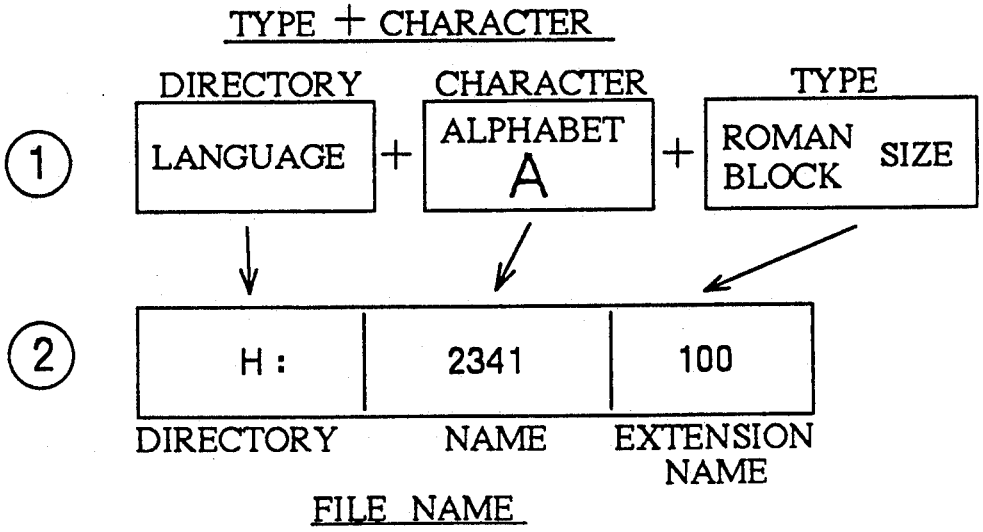
FIG. 26 is a chart which shows data for a file name assigned to a combined pattern.
Figure 27:
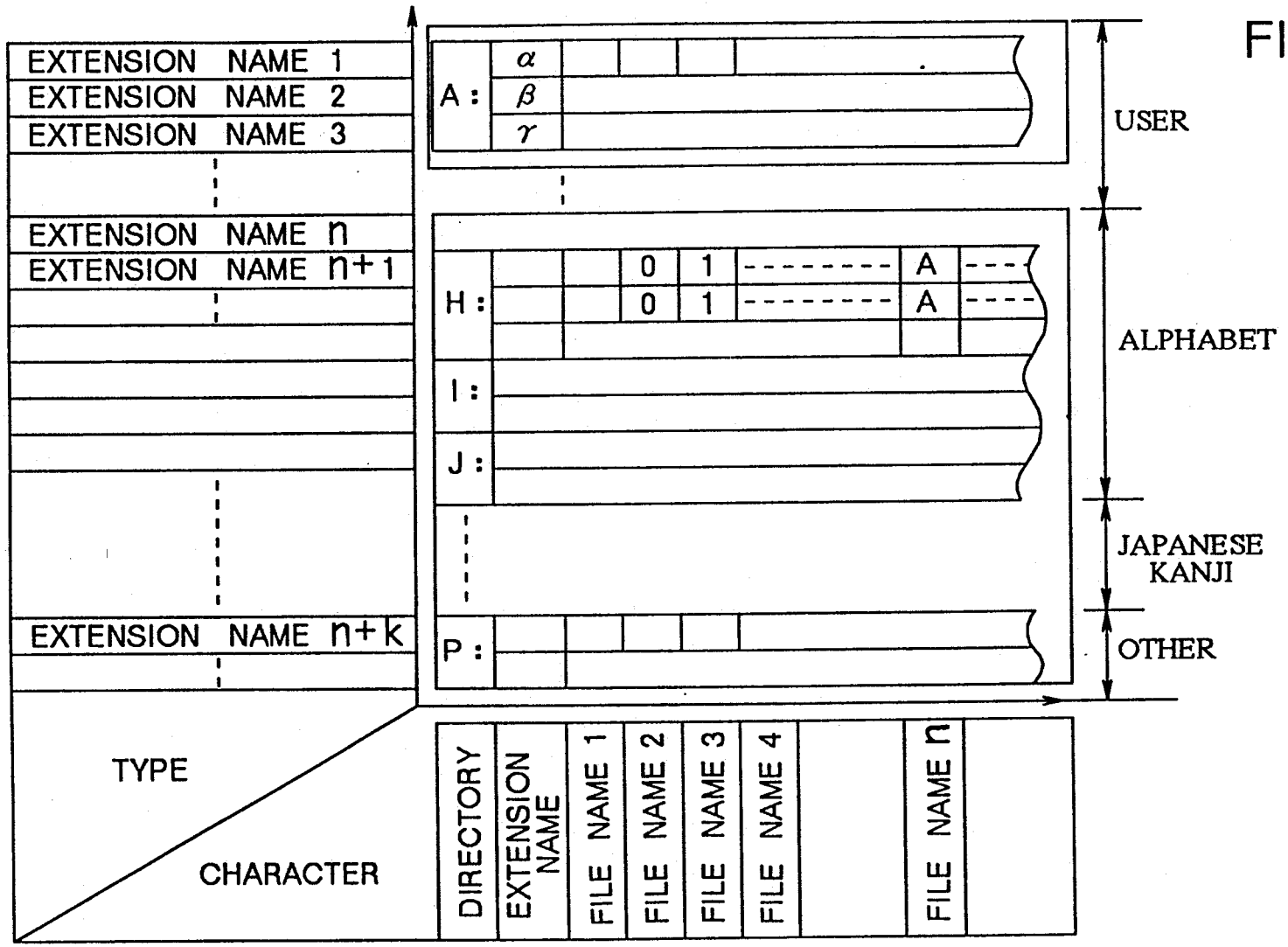
FIG. 27 is a memory map of the computer which corresponds to a keyboard displayed on the display 4.
Figures 32, 33, 34:
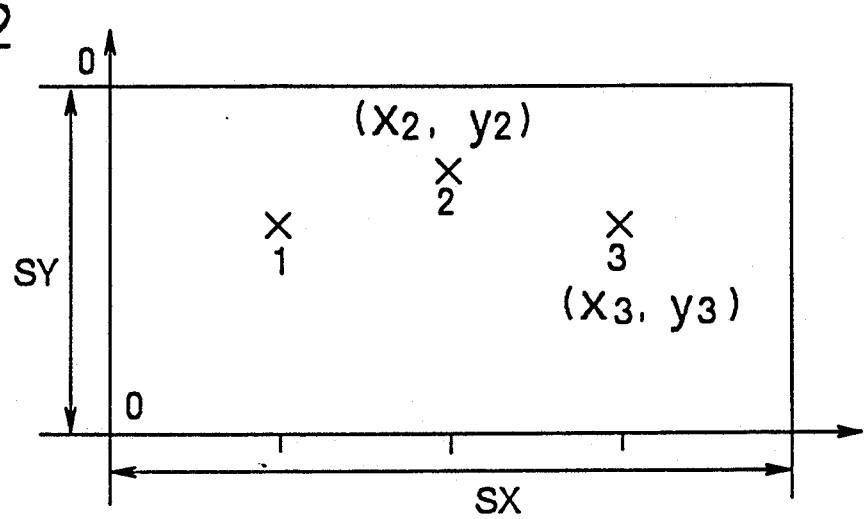
FIG. 32 is a drawing which shows the three points on the display 4.
FIG. 33 is a chart which shows data that corresponds to the three points shown in FIG. 32 registered in the register.
FIG. 34 is a chart which shows data of the layout register in accordance with the operation of combination routine 36 shown in FIG. 3.
Figure 35:
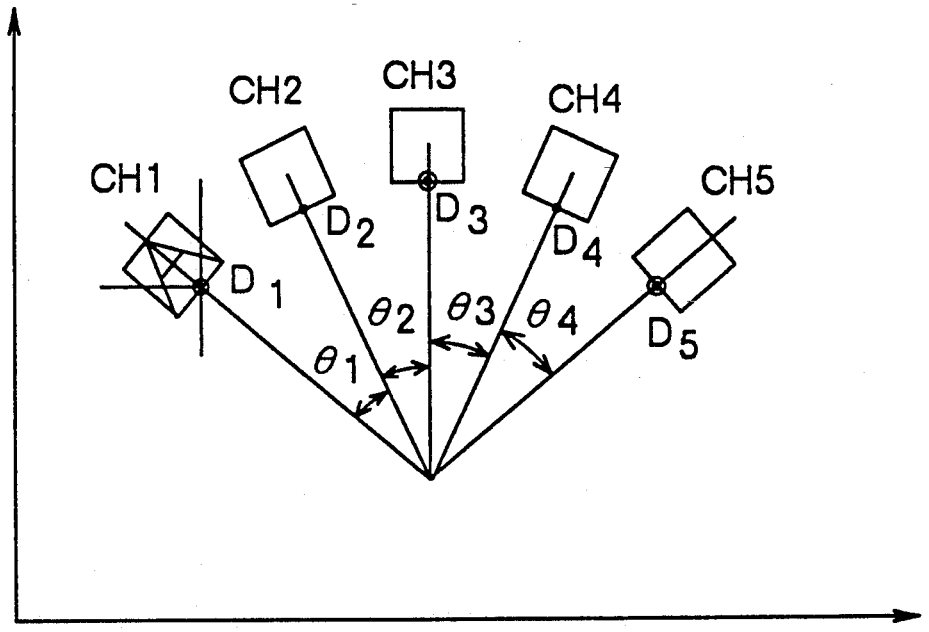
FIG. 35 is an image on the display 4 in accordance with the signals of the combination routine 36.
Figure 36:
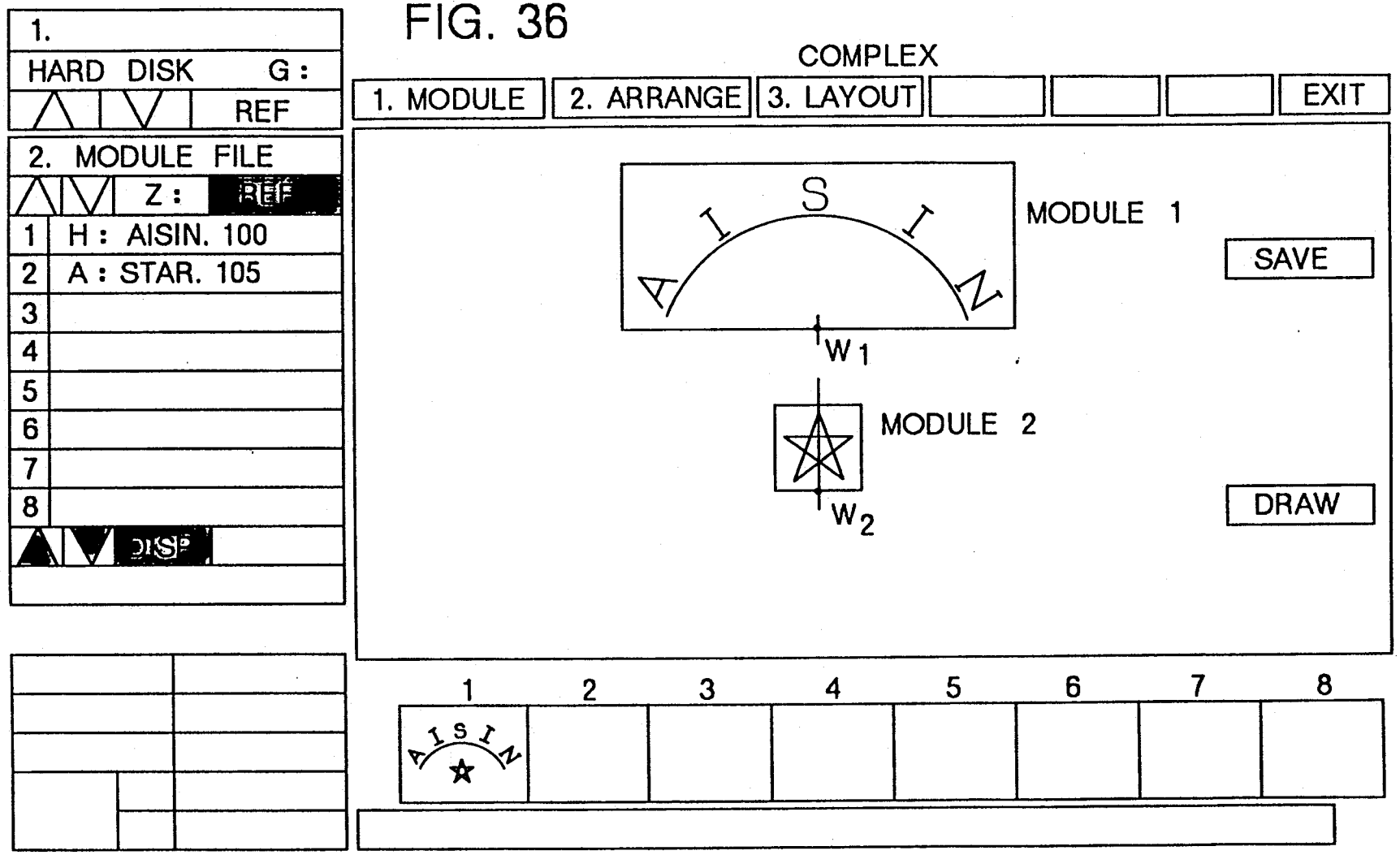
FIG. 36 is an image on the display 4 in accordance with the signals sent by the controller 1 shown in FIG. 2.
Figure 37:
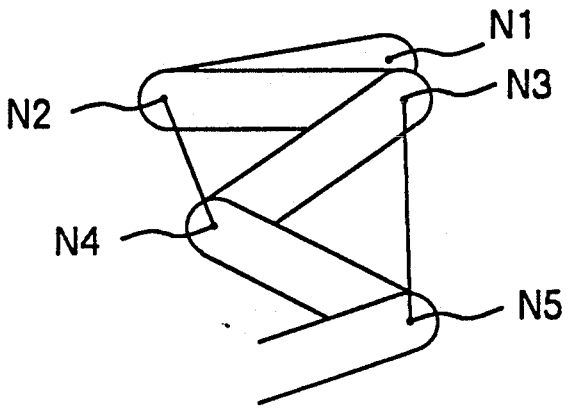
FIG. 37 is an enlarged image on the display 4 in accordance with the "thread density routine" 34 shown in FIG. 15.

When the three points are input, the main computer 20 divides the curve which goes through the three points into five points D1 to D5 as shown in FIG. 35 and writes the point coordinates into the layout register (FIG. 34). The starting point W of the embroidering data CH is placed on each of the divided coordinates R(x1, y1) to R(x5, y5). The main computer 20 rotates each character on the starting point W to where the character makes a right angle on the curve. The rotation angles are 01 to 04 as shown in FIG. 35. The main computer 20 displays the rotated characters on the screen as shown in FIG. 28. After an operator confirms the display, an operator indicates to save the new data. The main computer 20 executes the "Register as new file" in FIG. 11 to save the data on the hard disk 18 with a new file name (FIG. 26). The main computer 20 then displays new file name at the "2. MONOGRAM" on the screen as shown in FIG. 28. The file name contains a directory of the keyboard pattern, letter code and character code. A directory assigned to the directory is shown in FIG. 27.

As with the arrangement of alphabetical letters mentioned above, arrangements of Japanese, Thai and Spanish letters are the same. An operator selects "1. CHARACTER" on the screen in FIG. 21 to change the screen to a "CHARACTER screen" then selects one of Japanese, Thai or Spanish. FIG. 30 shows Thai keyboards and FIG. 31 shows Japanese keyboards.

When an operator selects "6. COMPLEX" from the initial screen as shown in FIG. 16, the main computer 20 executes "combining routine" 36 in FIG. 14. First the combining screen is displayed. When an operator inputs "1. MODULE" at the top of the screen and selects a recording media either from the hard disk 18 or the floppy disk 14, the main computer 20 displays the file name in the recording media. The file names scrolls as an operator operates the cursor to select the desired one. Thus the basic pattern is selected. Then the additional pattern will be selected in the same way.

Figure 14:
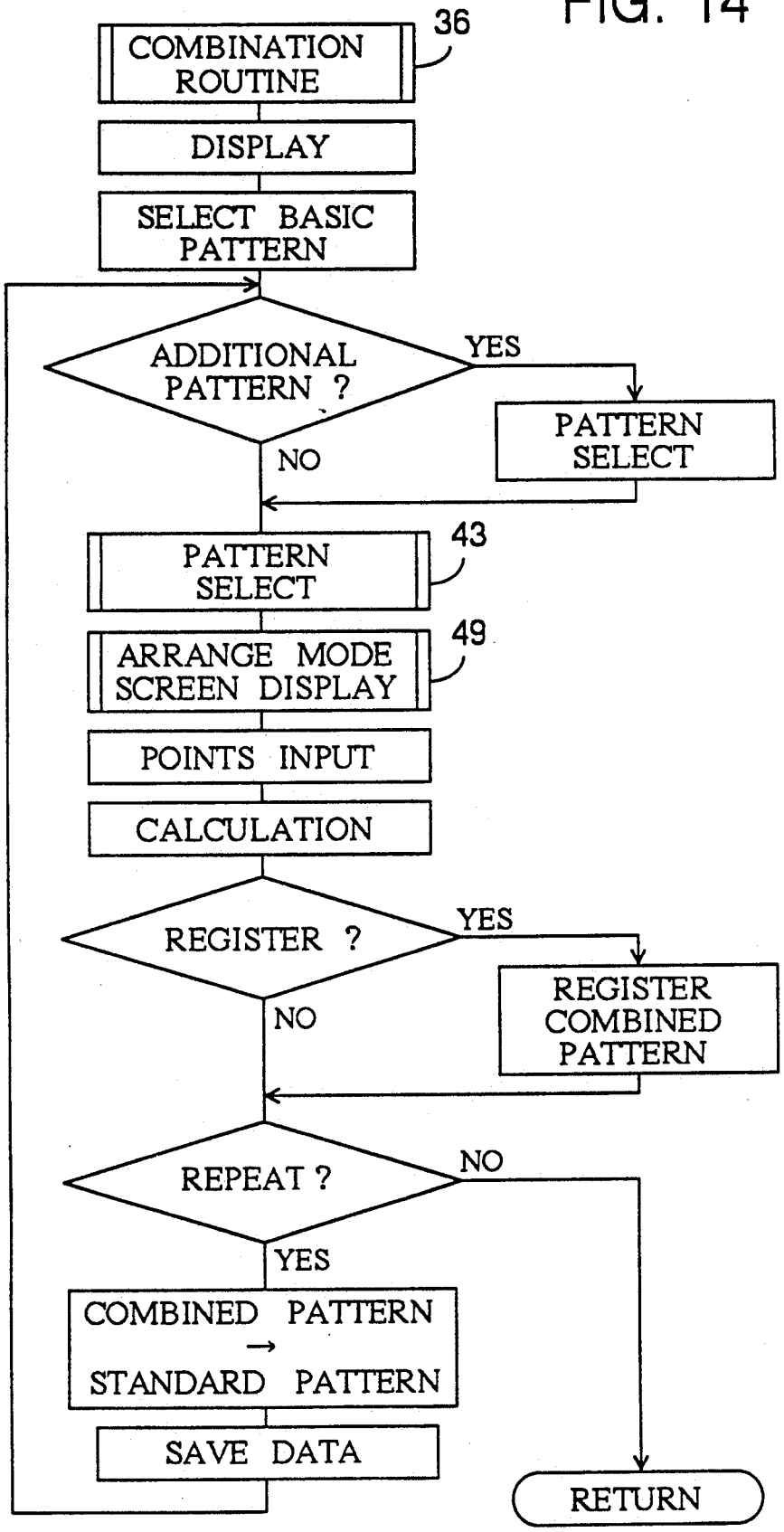
FIG. 14 is a flow chart which shows an operation of combination routine 36 shown in FIG. 3.
Figure 15:
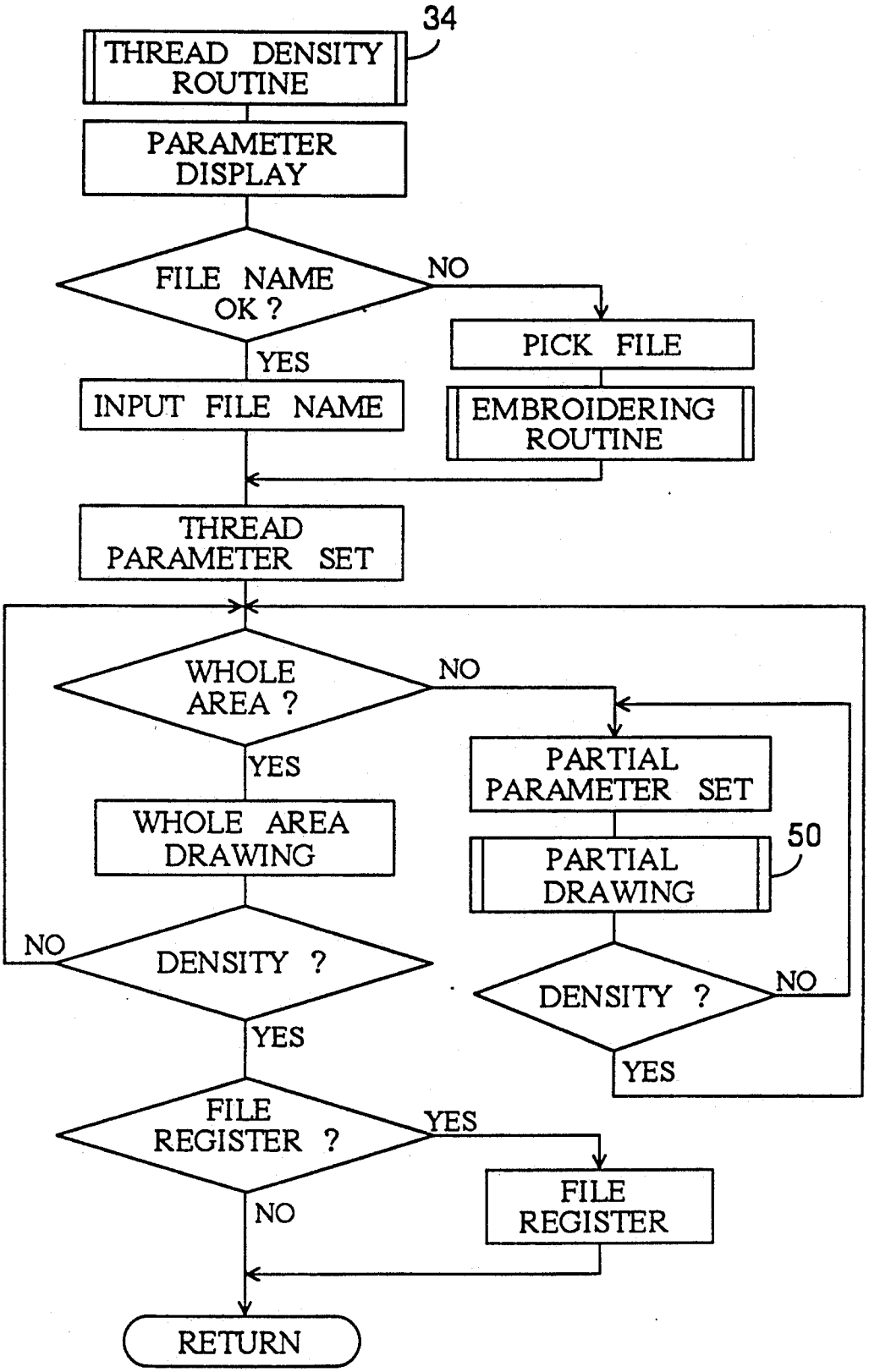
FIG. 15 is a flow chart which shows an operation of "thread density routine" 34 shown in FIG. 3.

An operator selects "2. Arrange" and the main computer 20 executes the "Select the patterns" 43 and "display arrange mode" through "Register the combined pattern". The operations are the same as that of the "Monogram" 33 in FIG. 11. A combined pattern can be made by continuing this process. The bottom four blocks of FIG. 14 show one example of the combined pattern.

When an operator selects "4. THREAD DENSITY" from the initial screen (FIG. 16), the main computer 20 executes the "Thread density" routine 34. The main computer 20 displays "thread density parameter display" on the screen. An operator selects the file name from the screen and sets the parameters, such as increased or reduced rate of the thread and the area of the pattern to be checked. When the selected area does not cover the whole pattern, the process will be continued until the whole area is covered. The result will be displayed on the screen for an operator to check.

Figure 38:
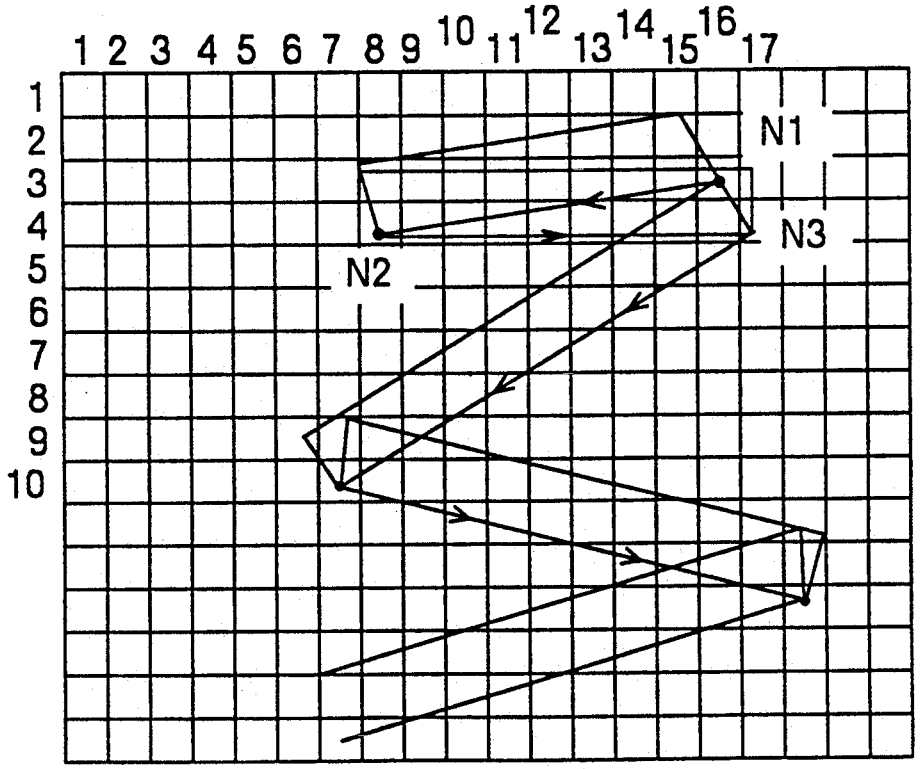
FIG. 38 is an enlarged image on the display 4 in accordance with the "thread density routine" 34 shown in FIG, 15.
Figure 39:
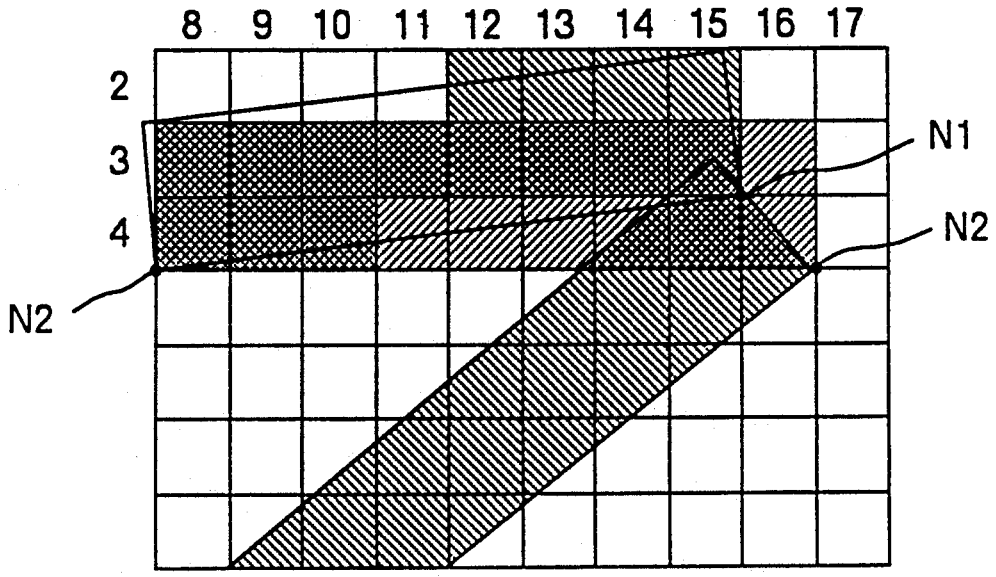
FIG. 39 is an enlarged image on the display 4 in accordance with the "thread density routine" 34 shown in FIG. 15.
Figure 40:
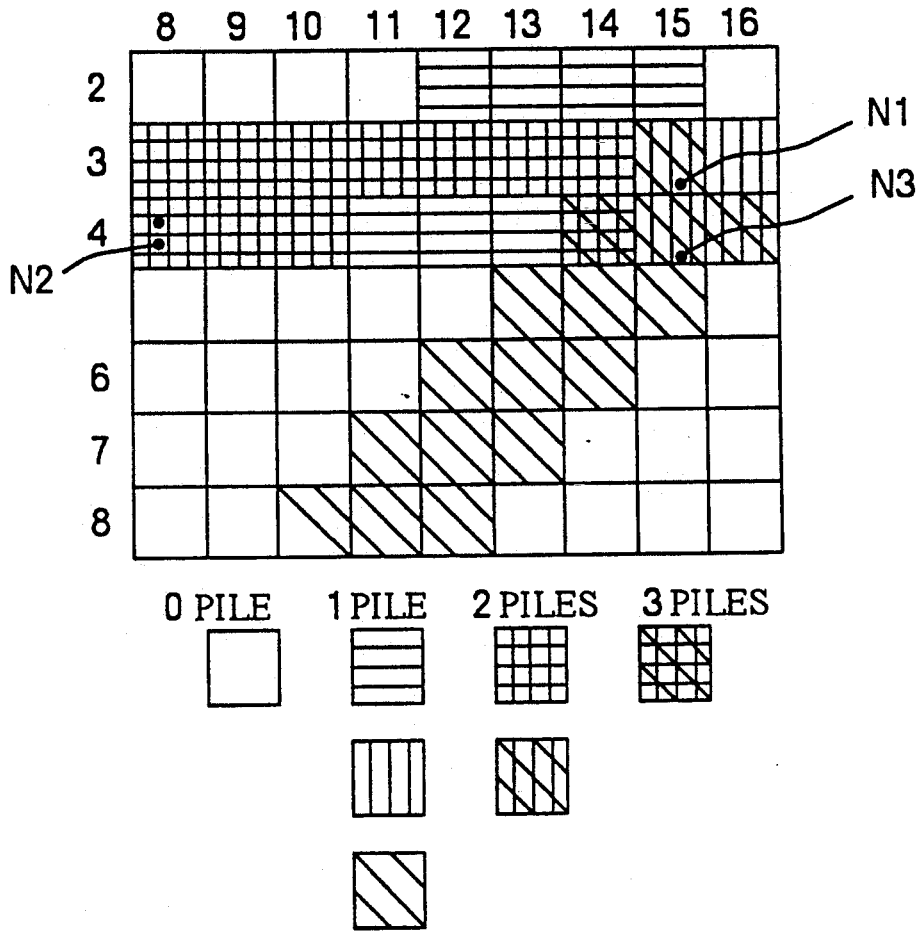
FIG. 40 is an enlarged image on the display 4 in accordance with the "thread density routine" 34 shown in FIG. 15.
Figure 41:
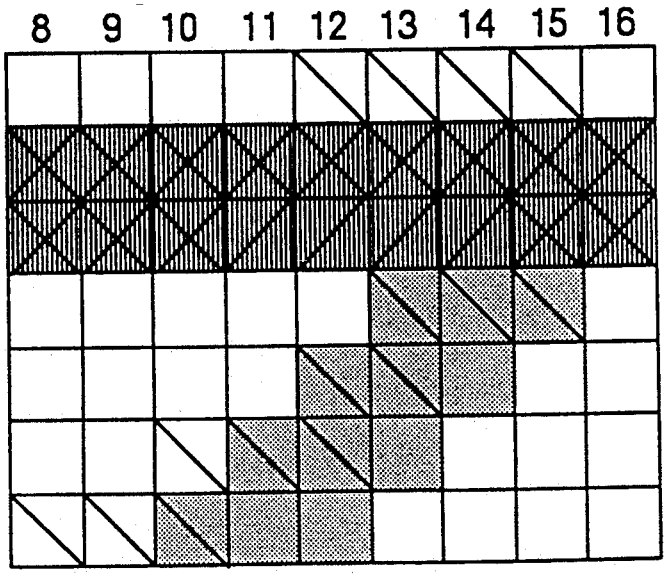
FIG. 41 is an enlarged image on the display 4 in accordance with the "thread density routine" 34 shown in FIG. 15.
Figure 42:
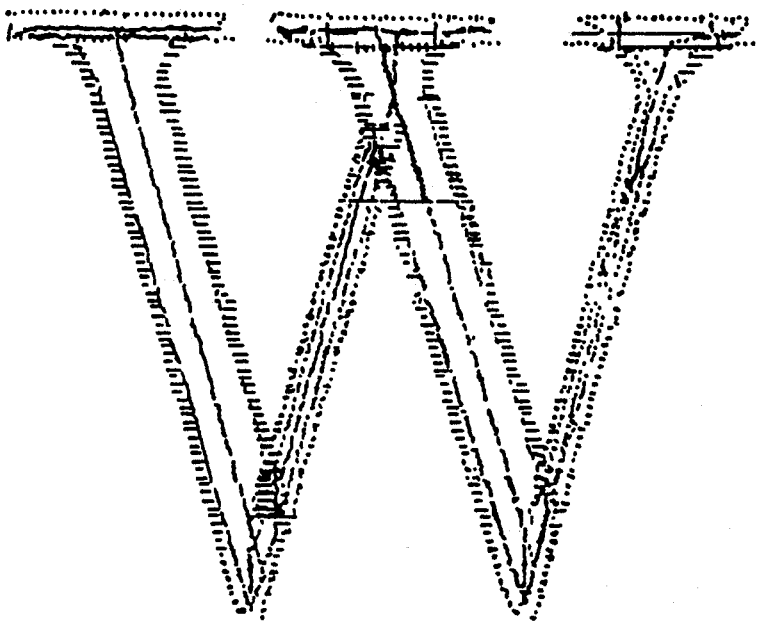
FIG. 42 is an image on the display 4 in accordance with the signals sent by the controller 1 shown in FIG. 2.

When the thread is embroidering along with the points N1–N2–N3–N4–N5, some threads cross each other and some do not. If the thread density is too low, the cloth can be seen through the threads. In the "area drawing routine" 50 in FIG. 15, the main computer 20 draws lines along with the points N1–N2–N3–N4–N5 on the display 4. The pitch of the screen is 0.3 mm and the width of the thread is indicated as shown in FIG. 40. The line from the point N1 to the point N2 is drawn in color A. The line from the point N2 to the point N3 is drawn on with the color A but the crossing area on the line between N1 and N2 is colored in B (FIGS. 38, 39). The line from the point N3 to the point N4 is then drawn in color A but the crossing area is put in different color (FIGS. 40, 42). FIG. 42 shows a print out of the result with a dot matrix printer wherein the dot density shows thread density.

The invention has been described in an illustrative manner, and it is to be understood that the terminology which has been used in intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

What is claimed is:

1. A system for embroidering comprising:
a plurality of embroidering machines, each embroidering machine having:
an embroidery frame;
a frame motor for moving said frame in X and Y directions;
a needle motor for a needle;
memory means for storing embroidering data; and
control means for controlling said frame motor and said needle motor in accordance with said embroidering data, said embroidering system further including:
display means;
input means having a keyboard and a means for inputting coordinates on a screen of said display;
register memory means for storing an embroidering pattern, image data and embroidering data for characters of several languages having different character symbols for the same phonetic sound; and
main control means for:
(a) checking a phonetic sound input by said input means and for determining whether such phonetic sound corresponds to more than one character,
(b) reading image data corresponding to all of said characters which have the phonetic sound,
(c) displaying all of said image data on said display means,
(d) selecting a desired character from said displayed characters by using said input means,
(e) registering said desired character into said register memory means, and
(f) sending embroidering data for an embroidering pattern corresponding to said registered desired character stored in said register memory means to said memory means of said embroidering machine.

2. System according to claim 1, wherein said main control means displays said registered desired character on said display means, selects an additional character and displays said additional character onto the same screen on which said registered desired character is displayed.

3. System according to claim 1, wherein said register memory means is a read and write data storage device.

4. System according to claim 2, wherein said register memory means further includes a removable data storage media.

5. Apparatus according to claim 1, wherein said main control means further controls said display means to display an area of an embroidering pattern covered by thread so that thread density can be checked.

6. Apparatus for embroidering comprising:
a plurality of embroidering machines for receiving embroidering data;
display means for displaying image data;
input means for selecting image data to be displayed;
memory means for storing embroidering patterns, each of said embroidering patterns having corresponding image data and embroidering data for characters of several languages, said characters having different character symbols for the same phonetic sound; and
main control means for determining whether a phonetic sound selected via said input means corresponds to image data for more than one character stored in said memory means, for controlling a display of image data which corresponds to said phonetic sound and for sending embroidering data for an embroidering pattern which corresponds to a selected one of said character symbols to at least one of said plurality of embroidering machines.

7. Apparatus according to claim 6, wherein each of said embroidering machines further includes:
an embroidery frame;
a frame motor for moving said frame in X and Y directions;
a needle motor for a needle;
a memory for storing embroidering data; and
control means for controlling said frame motor and said needle motor in accordance with said embroidering data.

8. Apparatus according to claim 7, wherein said main control means further includes:
means for reading image data of all characters which have the same phonetic sound;
means for displaying said image data for all characters which have a selected phonetic sound on said display means;
means for selecting a desired character from said displayed image data in response to said input means; and
means for registering said desired character into said memory means for transfer to said at least one of said plurality of embroidering machines.

* * * * *